US011306263B1

(12) United States Patent
Choi et al.

(10) Patent No.: US 11,306,263 B1
(45) Date of Patent: Apr. 19, 2022

(54) PROCESSES FOR THERMAL UPGRADING OF HEAVY OILS UTILIZING DISULFIDE OIL

(71) Applicant: Saudi Arabian Oil Company, Dhahran (SA)

(72) Inventors: Ki-Hyouk Choi, Dhahran (SA); Mazin M. Fathi, Dhahran (SA); Maddala Venkata Bhanumurthy, Yanbu (SA); Abdullah M. Salma, Dammam (SA); Faisal M. Almulla, Dhahran (SA); Ali M. Alsomali, Dhahran (SA); Young-Kyoung Ahn, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/167,412

(22) Filed: Feb. 4, 2021

(51) Int. Cl.

| | |
|---|---|
| ***C10G 9/16*** | (2006.01) |
| ***C10G 11/06*** | (2006.01) |
| ***C07C 4/04*** | (2006.01) |
| ***C10G 55/04*** | (2006.01) |
| ***C10G 9/00*** | (2006.01) |

(52) U.S. Cl.
CPC ..... *C10G 55/04* (2013.01); *C10G 9/005* (2013.01); *C10G 9/007* (2013.01); *C10G 2300/107* (2013.01); *C10G 2300/1011* (2013.01); *C10G 2300/1077* (2013.01); *C10G 2300/201* (2013.01); *C10G 2300/205* (2013.01); *C10G 2300/207* (2013.01); *C10G 2300/301* (2013.01); *C10G 2300/305* (2013.01); *C10G 2300/307* (2013.01); *C10G 2300/308* (2013.01)

(58) Field of Classification Search
CPC ..... C10G 9/16; C10G 11/06; C07C 4/04
See application file for complete search history.

(56) References Cited

U.S. PATENT DOCUMENTS

| | | | | |
|---|---|---|---|---|
| 4,399,024 | A * | 8/1983 | Fukui | C10B 55/00 208/114 |
| 4,412,912 | A * | 11/1983 | Asdigian | C10G 27/06 208/206 |
| 4,636,297 | A * | 1/1987 | Uchiyama | C10G 9/16 208/113 |
| 5,258,115 | A | 11/1993 | Heck et al. | |
| 8,057,707 | B2 | 11/2011 | Srinivas et al. | |
| 8,791,314 | B2 * | 7/2014 | Fremy | C10G 9/16 585/650 |
| 2016/0312129 | A1 | 10/2016 | Choi et al. | |
| 2019/0264110 | A1 | 8/2019 | Choi et al. | |

OTHER PUBLICATIONS

Baldwin et al., "Coal liquefaction catalysis", Fuel, vol. 62, pp. 498-501, May 1983.
Gould et al., "Natural Hydrogen Donors in Petroleum Resids", Energy & Fuels, vol. 21, pp. 1199-1204, 2007.
Luo, "Handbook of Bond Dissociation Energies in Organic Compounds", CRC Press; 1 edition, ISBN-10: 0849315891, ISBN-13: 978-0849315893, Dec. 26, 2002.
U.S. EPA HPV Challenge Program, "Reclaimed Substances: Disulfides, Diethyl and Diphenyl, Naphtha Sweetening (Revised) (aka Disulfide Oil)", CAS # 68955-96-4, EPA, Dec. 16, 2010.
Zimmerman et al., "Ethylene", Ullmann's Encyclopedia of Industrial Chemistry, DOI: 10.1002/14356007.a10_045.pub3, 2012.

* cited by examiner

*Primary Examiner* — Randy Boyer
(74) *Attorney, Agent, or Firm* — Dinsmore & Shohl, LLP

(57) ABSTRACT

A process for upgrading a heavy oil includes passing heavy oil and disulfide oil to a thermal cracking system that includes a thermal cracking unit and a cracker effluent separation system downstream of the thermal cracking unit and thermally cracking at least a portion of the heavy oil in the presence of the disulfide oil in the thermal cracking unit to produce solid coke and a cracking effluent comprising reaction products. The reaction products include one or more liquid reaction products, one or more gaseous reaction products, or both. The presence of the disulfide oil in the thermal cracking unit promotes conversion of hydrocarbons from the heavy oil to the liquid reaction products, the gaseous reaction products, or both relative to the production of the solid coke.

20 Claims, 5 Drawing Sheets

PROCESSES FOR THERMAL UPGRADING OF HEAVY OILS UTILIZING DISULFIDE OIL

BACKGROUND

Field

The present disclosure relates to systems and processes for processing petroleum-based materials and, in particular, systems and processes for thermal upgrading of heavy oils using disulfide oil streams.

Technical Background

Petroleum-based materials can be converted to petrochemical products, such as fuel blending components, olefins, and aromatic compounds, which are basic intermediates for a significant portion of the petrochemical industry. Conversion of petroleum-based materials to petrochemical products generally starts with separating an incoming crude oil or other petroleum-based feed stream into various distillate fractions and then processing each of the separate distillate fractions into the various petrochemical products. The lesser value heavy oils, which include the greater boiling constituents of the crude oil, can be upgraded to greater value liquid or gaseous petrochemical products or intermediates through either of two categories of processes. In the first category, the heavy oils can be upgraded through hydrogen addition by contacting the hydrocarbons in the heavy oils with hydrogen in the presence of a hydrocracking catalysts to crack and saturate the hydrocarbons to produce the greater value petrochemical products in conjunction with other chemical processes such as a steam cracker.

For processes in the second category, carbon is rejected from the hydrocarbon molecules as solid or highly viscous materials having a greater carbon/hydrogen ratio compared to the liquid products produced. Representative processes in the second category, which focuses on the carbon rejection route, include thermal cracking processes such as visbreaker and delayed coker processes. These thermal cracking processes are operable to produce more valuable liquid and gaseous petrochemical products in conjunction with other chemical processes such as a steam cracker, but also produce solid coke and greater viscosity liquid streams that are of lesser value.

Also common in refinery processes is the removal of sulfur from various hydrocarbon feed streams or product streams. Sulfur and sulfur containing compounds can be removed from hydrocarbon feed streams or product streams through sweetening processes, which can generate waste streams containing these sulfur and sulfur containing compounds. In particular, waste streams from sweetening processes can contain disulfide oil, which is one of the most problematic waste streams in refineries and gas plants. High sulfur containing wastes, such as disulfide oils, are very difficult to treat by conventional waste water treatment processes such as bioreactors or oxidation reactors.

SUMMARY

Accordingly, there is an ongoing need for systems and processes for upgrading heavy oils to greater value petrochemical products through thermal cracking while reducing formation of lower value materials, such as lesser quality coke or greater viscosity liquid streams. Additionally, there is an ongoing need for processes that provide a beneficial use for disulfide oil waste streams from sweetening processes. The inventors of the present disclosure have found that incorporating disulfide oil streams recovered from sweetening processes into the hydrocarbon feed introduced to thermal cracking processes can promote formation of liquid and gaseous petrochemical products and intermediates and reduce the yield of coke produced by the thermal cracking processes compared to thermal cracking conducted without the disulfide oil.

The systems and processes of the present disclosure include a passing heavy oil and disulfide oil to a thermal cracking system comprising a thermal cracking unit and the cracker effluent separation system downstream of the thermal cracking unit. At least a portion of the heavy oil and the disulfide oil are thermally cracked in the thermal cracking unit to produce solid coke and a cracking effluent comprising one or more reaction products, which may include liquid reaction products, gaseous reaction products, or both. The presence of the disulfide oil may promote conversion of hydrocarbons from the heavy oil to the liquid and gaseous reaction products instead of the solid coke. The presence of the disulfide oil in the thermal cracking unit may reduce formation of the solid coke compared to operating the thermal cracking unit without the disulfide oil. Introducing the disulfide oil to the thermal cracking processes may also improve the quality of the solid coke produced by the thermal cracking process, such as by reducing contaminants or by producing a greater proportion of high grade coke, such as a needle coke, compared to other grades of solid coke. The systems and processes of the present disclosure may provide a beneficial use for the disulfide oil streams produced from sweetening processes, among other features of the processes of the present disclosure.

According to at least one aspect of the present disclosure, a process for upgrading a heavy oil may include passing heavy oil and disulfide oil to a thermal cracking system comprising a thermal cracking unit and a cracker effluent separation system downstream of the thermal cracking unit and thermally cracking at least a portion of the heavy oil in the presence of the disulfide oil in the thermal cracking unit to produce solid coke and a cracking effluent comprising one or more reaction products. The one or more reaction products comprise one or more liquid reaction products, one or more gaseous reaction products, or both. The presence of the disulfide oil promotes conversion of hydrocarbons from the heavy oil to the liquid reaction products, the gaseous reaction products, or both over the solid coke.

Additional features and advantages of the aspects of the present disclosure will be set forth in the detailed description that follows and, in part, will be readily apparent to a person of ordinary skill in the art from the detailed description or recognized by practicing the aspects of the present disclosure.

BRIEF DESCRIPTION OF THE DRAWINGS

The following detailed description of the present disclosure may be better understood when read in conjunction with the following drawings in which.

When describing the simplified schematic illustrations of FIGS. 1-5, many of the numerous valves, temperature sensors, electronic controllers, and the like, which may be used and are well known to a person of ordinary skill in the art, may not be included. Further, accompanying components that are often included in systems such as those depicted in FIGS. 1-5, such as air supplies, heat exchangers, surge tanks, and the like are also not included. However, a person of ordinary skill in the art understands that these components are within the scope of the present disclosure.

Additionally, the arrows in the simplified schematic illustrations of FIGS. 1-5 refer to process streams. However, the arrows may equivalently refer to transfer lines, which may transfer process streams between two or more system components. Arrows that connect to one or more system components signify inlets or outlets in the given system components and arrows that connect to only one system component signify a system outlet stream that exits the depicted system or a system inlet stream that enters the depicted system. The arrow direction generally corresponds with the major direction of movement of the process stream or the process stream contained within the physical transfer line signified by the arrow.

The arrows in the simplified schematic illustrations of FIGS. 1-5 may also refer to process steps of transporting a process stream from one system component to another system component. For example, an arrow from a first system component pointing to a second system component may signify "passing" a process stream from the first system component to the second system component, which may comprise the process stream "exiting" or being "removed" from the first system component and "introducing" the process stream to the second system component.

Moreover, two or more lines intersecting in the simplified schematic illustrations of FIGS. 1-5 may refer to two or more process streams being "mixed" or "combined". Mixing or combining two or more process streams may comprise mixing or combining by directly introducing both streams into a like reactor, separation device, or other system component. For example, two lines intersecting prior to entering a system component may signify the introduction of the two process streams into the system component, in which mixing or combining occurs.

Reference will now be made in greater detail to various aspects of the present disclosure, some of which are illustrated in the accompanying drawings.

DETAILED DESCRIPTION

Figure 1:
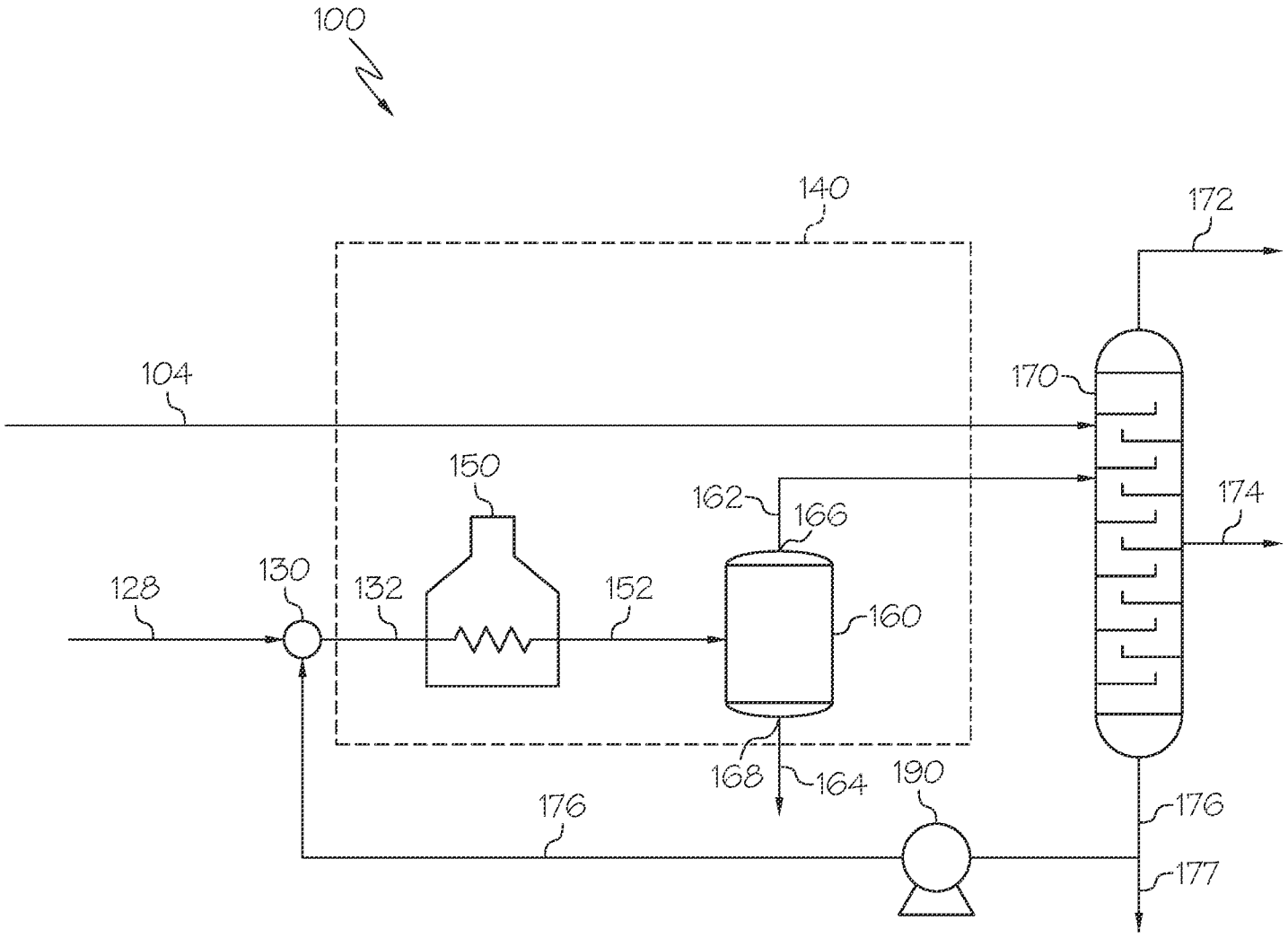
FIG. 1 schematically depicts a generalized flow diagram of a process for upgrading heavy oils, according to one or more aspects shown and described in the present disclosure.

The present disclosure is directed to systems and processes for thermally upgrading heavy oils to produce more valuable petrochemical products, such as fuels or chemical intermediates. In particular, the present disclosure is directed to processes for upgrading heavy oils through thermal cracking in the presence of disulfide oil to reduce formation of solid coke and increase conversion of the hydrocarbons from the heavy oil to gaseous and liquid reaction products. Referring now to FIG. 1, a generalized flow diagram of one embodiment of a thermal cracking system 100 for upgrading heavy oils according to the present disclosure is schematically depicted. The thermal cracking system 100 includes a thermal cracking unit 140 and a cracker effluent separation system 170 disposed downstream of the thermal cracking unit 140. The processes of the present disclosure include passing the heavy oil, in heavy oil stream 104, and disulfide oil, in disulfide oil stream 128, to the thermal cracking system 100. The processes further include thermally cracking at least a portion of the heavy oil from the heavy oil stream 104 in the presence of the disulfide oil from the disulfide oil stream 128 in the thermal cracking unit 140 to produce solid coke 164 and a cracking effluent 162 comprising one or more reaction products. The one or more reaction products may include one or more liquid reaction products, one or more gaseous reaction products, or both. The presence of the disulfide oil from the disulfide oil stream 128 may moderate or suppress formation of the solid coke 164 and promote conversion of hydrocarbons of the heavy oil stream 104 to produce liquid reaction products, the gaseous reaction products, or both.

Not intending to be bound by any particular theory, it is believed that disulfide compounds in the disulfide oil may function as initiators for radical chain reactions in the thermal cracking unit 140 that may promote conversion of some heavier hydrocarbon compounds from the heavy oil to the greater value gaseous and liquid reaction products, as described in further detail in the present disclosure. Thus, the processes of the present disclosure may provide greater conversion of hydrocarbons to the greater value liquid and gaseous reaction products and reduce the formation of solid coke compared to thermal conversion of heavy oils without the disulfide oil. The presence of the disulfide oil may also improve the quality of the solid coke produced in the thermal cracking process. Additionally, the processes of the present disclosure may provide a beneficial and productive use of disulfide oil waste streams from hydrocarbon sweetening processes, among other features. Other features or benefits of the systems and processes of the present disclosure may become apparent to those of ordinary skill in the art from practicing the subject matter of the present disclosure.

The indefinite articles "a" and "an" are employed to describe elements and components of the present disclosure. The use of these articles means that one or at least one of these elements or components is present. Although these articles are conventionally employed to signify that the modified noun is a singular noun, as used herein the articles "a" and "an" also include the plural, unless otherwise stated in specific instances. Similarly, the definite article "the", as used in the present disclosure, also signifies that the modified noun may be singular or plural, again unless otherwise stated in specific instances.

As used in the present disclosure, the term "reactor" refers to any vessel, container, or the like, in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors, such as fixed bed reactors, and ebullated bed reactors. One or more "reaction zones" may be disposed within a reactor. As used in the present disclosure, the term "reaction zone" refers to a region or volume where a particular reaction takes place within a reactor. For example, a packed bed reactor with multiple catalyst beds may have multiple reaction zones, where each reaction zone is defined by the volume of each catalyst bed.

As used in the present disclosure, a "separation unit" refers to any separation device that at least partially separates one or more chemicals in a mixture from one another. For example, a separation unit may selectively separate different chemical species from one another, forming one or more chemical fractions. Examples of separation units include, without limitation, distillation columns, fractionators, flash drums, knock-out drums, knock-out pots, centrifuges, filtration devices, traps, scrubbers, expansion devices, membranes, solvent extraction devices, high-pressure separators, low-pressure separators, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided or separated into two or more process streams of desired composition.

As used in this disclosure, the term "fractionation" may refer to a process of separating one or more constituents of a composition in which the constituents are divided from each other during a phase change based on differences in properties of each of the constituents. As an example, as used in this disclosure, "distillation" refers to separation of constituents of a liquid composition based on differences in the boiling point temperatures of constituents of a composition.

As used in this disclosure, the terms "upstream" and "downstream" may refer to the relative positioning of unit operations with respect to the direction of flow of the process streams. A first unit operation of a system may be considered "upstream" of a second unit operation if process streams flowing through the system encounter the first unit operation before encountering the second unit operation. Likewise, a second unit operation may be considered "downstream" of the first unit operation if the process streams flowing through the system encounter the first unit operation before encountering the second unit operation.

As used in the present disclosure, passing a stream or effluent from one unit "directly" to another unit may refer to passing the stream or effluent from the first unit to the second unit without passing the stream or effluent through an intervening reaction system or separation system that substantially changes the composition of the stream or effluent. Heat transfer devices, such as heat exchangers, preheaters, coolers, condensers, or other heat transfer equipment, and pressure devices, such as pumps, pressure regulators, compressors, or other pressure devices, are not considered to be intervening systems that change the composition of a stream or effluent. Combining two streams or effluents together also is not considered to comprise an intervening system that changes the composition of one or both of the streams or effluents being combined.

As used in the present disclosure, the term "end boiling point" or "EBP" of a composition refers to the temperature at which the greatest boiling temperature constituents of the composition transition from the liquid phase to the vapor phase.

As used in the present disclosure, the term "effluent" refers to a stream that is passed out of a reactor, a reaction zone, or a separation unit following a particular reaction or separation. Generally, an effluent has a different composition than the stream that entered the separation unit, reactor, or reaction zone. It should be understood that when an effluent is passed to another system unit, only a portion of that system stream may be passed. For example, a slip stream may carry some of the effluent away, meaning that only a portion of the effluent may enter the downstream system unit. The term "reaction effluent" may more particularly be used to refer to a stream that is passed out of a reactor or reaction zone.

The term "cracking" refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds.

It should be understood that the reactions promoted by catalysts as described in the present disclosure may remove a chemical constituent, such as only a portion of a chemical constituent, from a process stream or may react all or only a portion of reactants in a reactor feed. For example, the systems and processes of the present disclosure may comprise a catalyst in an amount sufficient to promote a cracking reaction that may convert a larger hydrocarbon molecule into smaller hydrocarbon molecules. It should be understood that, throughout the present disclosure, a particular catalyst may not be limited in functionality to the removal, conversion, or cracking of a particular chemical constituent or moiety when it is referred to as having a particular functionality.

It should further be understood that streams may be named for the components of the stream, and the component for which the stream is named may be the major component of the stream (such as comprising from 50 wt. %, from 70 wt. %, from 90 wt. %, from 95 wt. %, from 99 wt. %, from 99.5 wt. %, or from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "disulfide oil stream" passing to a first system component or from a first system component to a second system component should be understood to equivalently disclose "disulfide oil" passing to the first system component or passing from a first system component to a second system component.

As previously discussed, thermal cracking processes, such as but not limited to delayed coker processes or visbreaker processes, can upgrade heavy oils to solid coke and liquid and gaseous reaction products. Lesser molecular weight gaseous and liquid reaction products, such as light olefins, aromatic compounds, or other lesser molecular weight reaction products, have greater value due to their use as building blocks for downstream chemical synthesis processes compared to solid coke and greater molecular weight liquid products. Additionally, sweetening processes in a refinery produce a disulfide oil waste stream containing disulfides and other sulfur-containing compounds. As previously discussed, disulfide oil waste streams are difficult to treat by conventional treatment methods.

The systems and processes of the present disclosure utilize the disulfide oil as a reactant in thermal cracking processes to promote the formation of greater value gaseous and liquid reaction products in place of some of the solid coke. Referring now to FIG. 1, the thermal cracking systems 100 of the present disclosure for upgrading heavy oil is schematically depicted. The thermal cracking systems 100 include the heavy oil stream 104, the disulfide oil stream 128, the thermal cracking unit 140, and the cracker effluent separation system 170 downstream of the thermal cracking unit 140. The thermal cracking unit 140 may further include at least one furnace 150 and at least one cracking vessel 160 downstream of the at least one furnace 150. The heavy oil stream 104 may be in fluid communication with the cracker effluent separation system 170, which may be operable to separate the heavy oil stream 104 and a cracker effluent 162 from the thermal cracking unit 140 to produce at least one product stream (gaseous product stream 172, liquid product stream 174, or both) and a cracker bottom stream 176. The cracker effluent separation system 170 may be in fluid communication with the thermal cracking unit 140, such as with the furnace 150 of the thermal cracking unit 140, to pass the cracker bottom stream 176 to the thermal cracking unit 140. The disulfide oil stream 128 may be in fluid communication with the cracker bottom stream 176 or the thermal cracking unit 140, such as with the furnace 150. The thermal cracking unit 140 may be operable to thermally crack at least a portion of the cracker bottom stream 176 to produce the cracker effluent 162 comprising gaseous reaction products, liquid reaction products, or both. The presence of the disulfide compounds from the disulfide oil stream 128 may promote conversion of the heavy oil stream 104 to gaseous reaction products, liquid reaction products, or both and may moderate coke formation compared to operation of the thermal cracking unit 140 without the disulfide oil stream 128. The thermal cracking unit 140 may further be operable to crack at least a portion of the disulfide compounds from the disulfide oil stream 128 to produce additional gaseous reaction products, liquid reaction products, or both.

Referring again to FIG. 1, the heavy oil stream 104 may include a heavy oil, which may be a residue from distillation of a hydrocarbon feed. The hydrocarbon feed may be derived from petroleum, coal liquid, waste plastics, biomaterials, or combinations of these. In particular, the hydrocarbon feed may include one or more of crude oil, distilled crude oil, residue oil, topped crude oil, product streams from oil refineries, product streams from steam cracking processes, liquefied coals, liquids recovered from oil or tar sands, bitumen, shale oil, asphaltene, biomass hydrocarbons, or combinations of these.

The heavy oil of the heavy oil stream 104 may be an atmospheric residue, a vacuum residue, or both. Atmospheric residue may refer to a bottom stream produced through distillation of the hydrocarbon feed at atmospheric pressure and may comprise hydrocarbon constituents having boiling point temperatures greater than or equal to 350° C. A vacuum residue may refer to a bottom stream produced through distillation of the hydrocarbon feed or a portion of the hydrocarbon feed under vacuum (pressure less than atmospheric pressure) and may comprise constituents having boiling point temperatures greater than or equal to 450° C. When the heavy oil of the heavy oil stream 104 is an atmospheric residue, the heavy oil may include at least 90%, at least 95%, at least 98%, or at least 99% of the constituents from the hydrocarbon feed having a boiling point temperature greater than or equal to 350 degrees Celsius (° C.). When the heavy oil of the heavy oil stream 104 is a vacuum residue, the heavy oil may include at least 90%, at least 95%, at least 98%, or at least 99% of the constituents from the hydrocarbon feed having a boiling point temperature greater than or equal to 450° C.

The heavy oil of the heavy oil stream 104 may have a 10% boiling point temperature that is greater than or equal to 600 degrees Fahrenheit (315° C.), greater than or equal to 650 degrees Fahrenheit (343° C.), or even greater than or equal to 900 degrees Fahrenheit (482° C.). As used throughout the present disclosure, the 10% boiling point temperature of a composition may refer to the temperature at which 10% by weight of the constituents of the composition have transitioned from the liquid phase to the vapor phase. The 10% boiling point temperature may be determined through assessment of the distillation profile of the heavy oil according to ASTM D7169. Stated in other words, at least 90% by weight of the constituents of the heavy oil have a boiling point temperature greater than or equal to 315° C., greater than or equal to 345° C., or even greater than or equal to 480° C.

The heavy oil of the heavy oil stream 104 may have an API gravity of less than or equal to 16, or even less than or equal to 10 as determined in accordance with ASTM D287. The heavy oil of the heavy oil stream 104 may have a Conradson Carbon Residue (CCR) of greater than or equal to 5 weight percent (wt. %) or greater than or equal to 10 wt. % as determined in accordance with ASTM D189. When the CCR is less than 5 wt. %, the heavy oil may be less suited to thermal cracking processes such as delayed coking or visbreaking. The heavy oil of the heavy oil stream 104 may additionally include sulfur compounds. The heavy oil of the heavy oil stream 104 may include greater than 0 (zero) wt. %, greater than or equal to 1 wt. %, or greater than or equal to 2 wt. % sulfur compounds based on the total weight of the heavy oil stream 104. The heavy oil of the heavy oil stream 104 may include greater than 0 (zero) wt. % to 5 wt % or from 1 wt. % to 5 wt. % sulfur compounds based on the total weight of the heavy oil stream 104.

Referring again to FIG. 1, the disulfide oil of the disulfide oil stream 128 may comprise one or a plurality of disulfide compounds having from 1 to 10 carbon atoms, such as from 1 to 5 carbon atoms, or even from 1 to 4 carbon atoms. The disulfide compounds in the disulfide oil stream may have the general chemical formula (I).

$$R^1—S—S—R^2 \quad (I)$$

In chemical formula (I), $R^1$ and $R^2$ are hydrocarbon groups each having a number of carbon atoms from 1 to 10, such as 1, 2, 3, 4, 5, 6, 7, 8, 9, or 10. $R^1$ and $R^2$ may be the same or different. In embodiments, $R^1$ and $R^2$ may both be alkyl groups. In embodiments, $R^1$ and $R^2$ may each be alkyl groups having from 1 to 5 carbon atoms or from 1 to 4 carbon atoms. The disulfide compounds in the disulfide oil stream 128 may include but are not limited to dimethyl disulfide, methyl ethyl disulfide, methyl propyl disulfide, diethyl disulfide, ethyl propyl disulfide, methyl propyl disulfide, dipropyl disulfide, ethyl butyl disulfide, methyl butyl disulfide, propyl butyl disulfide, dibutyl disulfide, or combinations of these. The disulfide compounds of the disulfide oil stream 128 may have boiling point temperatures of from 50° C. to 500° C.

The disulfide oil stream 128 may include greater than or equal to 5 wt. %, greater than or equal to 10 wt. %, greater than or equal to 20 wt. %, or even greater than or equal to 50 wt. % disulfide compounds based on the total weight of the disulfide oil stream 128. In embodiments, the disulfide oil stream 128 may include from 5 wt. % to 100 wt. %, from 10 wt. % to 100 wt. %, from 20 wt. % to 100 wt. %, or from 50 wt. % to 100 wt. %, from 5 wt. % to 90 wt. %, from 10 wt. % to 90 wt. %, from 20 wt. % to 90 wt. %, from 5 wt. % to 50 wt. % from 5 wt. % to 20 wt. %, from 5 wt. % to 10 wt. %, from 10 wt. % to 50 wt. %, from 10 wt. % to 20 wt. %, from 20 wt. % to 50 wt. %, or from 50 wt. % to 90 wt. %, disulfide compounds based on the total weight of the disulfide oil stream 128. In embodiments, the disulfide oil stream 128 may include other hydrocarbons that do not contain sulfur. The disulfide oil stream 128 may also include small amounts of water. When present, the water content of the disulfide oil stream 128 may be less than or equal to 20 wt. %, less than or equal to 15 wt. %, or even less than or equal to 10 wt. % water based on the total weight of the disulfide oil stream 128.

The disulfide oil stream 128 may have a total sulfur content sufficient to increase the concentration of sulfur in the thermal cracking unit 140 compared to the concentration of sulfur in the thermal cracking unit 140 operated without the disulfide oil stream 128. The disulfide oil stream 128 may have a total sulfur content that is greater than a total sulfur content of the heavy oil stream 104. The disulfide oil stream 128 may have a total sulfur content that is greater than a total sulfur content of the cracker bottom stream 176 produced by the cracker effluent separation system 176. The disulfide oil of the disulfide oil stream 128 may include greater than or equal to 3 wt. % or greater than or equal to 5 wt. % total sulfur based on the total weight of the disulfide oil stream 128. The disulfide oil of the disulfide oil stream 128 may include from 3 wt. % to 30 wt. %, from 3 wt. % to 20 wt. %, from 3 wt. % to 10 wt. % from 5 wt. % to 30 wt. %, from 5 wt. % to 20 wt. %, from 5 wt. % to 10 wt. %, or from 10 wt. % to 20 wt. % sulfur based on the total weight of the disulfide oil stream 128. The disulfide oil of the disulfide oil stream 128 may include less than or equal to 100 parts per million by weight alkali metals based on the total weight of the disulfide oil stream 128, as determined through inductively coupled plasma mass spectrometry (ICP-MS) according to known methods. In other words, the disulfide oil of the disulfide oil stream 128 may have a concentration of alkali metal hydroxides, such as caustic, of less than or equal to 100 parts per million by weight based on the total weight of the disulfide oil stream 128, as determined through ICP-MS according to known methods.

The disulfide oil stream 128 may include a disulfide oil produced from a sweetening process, such as a sweetening process for removing sulfur and sulfur compounds from natural gas, liquefied petroleum gas (LPG), naphtha, kerosene, or other sulfur containing hydrocarbon streams. The sweetening process that produces disulfide oil may be a mercaptan oxidation process (MEROX), which will be described in further detail in the present disclosure.

Referring again to FIG. 1, the heavy oil stream 104 and the disulfide oil stream 128 may both be in fluid communication with the thermal cracking system 100 to pass the heavy oil stream 104 and the disulfide oil stream 128 directly to the thermal cracking system 100. The thermal cracking system 100 may be operable to conduct a thermal cracking process to crack at least a portion of the heavy oil stream 104, in the presence of the disulfide oil of the disulfide oil stream 128, to produce a cracking effluent 162 comprising one or more reaction products. The one or more reaction products may include one or more liquid reaction products, one or more gaseous reaction products, or both. The thermal cracking process may also produce solid coke 164. The presence of the disulfide oil may reduce formation of the solid coke 164 and may increase yields of the liquid reaction products, the gaseous reaction products, or both compared to operation of the thermal cracking process without the disulfide oil stream 128.

The thermal cracking processes of the present disclosure refers to processes in which no external supply of molecular hydrogen ($H_2$) is needed or provided to the process. The thermal cracking processes of the present disclosure do not include providing an external source of molecular hydrogen ($H_2$). Thermal cracking also does not require solid catalysts, such as hydrocracking catalysts or fluidized catalytic cracking catalyst, and is conducted without a solid catalyst. During thermal cracking, some portion of feedstock (heavy oil or residue oil) releases hydrogen and becomes coke (hydrogen depleted hydrocarbons). The released hydrogen can be incorporated into other hydrocarbon molecules or combined to form molecular hydrogen. Due to lack of catalysts in the process, molecular hydrogen hardly reacts with hydrocarbons. It is noted that about half of gaseous reaction products from thermal cracking, such as a delayed coker or visbreaker process, is methane ($CH_4$), which has the greatest hydrogen-to-carbon ratio among hydrocarbons. The production of methane suggests that hydrogen is available in the heavy oil to be transferred between hydrocarbon molecules.

As previously discussed, the heavy oil stream 104 used as the feed to the thermal cracking system 100 of the present disclosure can be a distillation residue, such as an atmospheric residue, vacuum residue, or combination of these. These distillation residues are thought to have high concentrations of aromatic compounds having very little hydrogen to donate. Not intending to be bound by any particular theory, it is now believed that these distillation residues may have large amounts of hydrogen atoms that could be transferred between hydrocarbon compounds, as reported in K. A. Gould and I. A. Wiehe, "Natural Hydrogen Donors in Petroleum Resids", Energy & Fuels, 21, 1199(2007), which is incorporated by reference in the present disclosure in its entirety. Gould et al. showed that a vacuum residue produced from vacuum distillation of Arabian light crude oil had a total amount of transferrable hydrogen (donor hydrogen) of as much as 1.4 grams of transferrable hydrogen per 100 grams of vacuum residue. Tetralin, one of the most commonly used hydrogen donors in chemical reactions and an example of a compound present in the heavy oil stream 104, includes about 3 grams of transferrable hydrogen per 100 grams of tetralin. From this, it is believed that the residue fractions of crude oil may have significant amounts of transferrable hydrogen, which may be utilized to produce greater value gaseous and liquid products instead of solid coke and methane. The systems and processes of the present disclosure aim to utilize a greater proportion of this transferrable hydrogen to produce the greater value gaseous and liquid products instead of losing the transferrable hydrogen to production of hydrogen gas and methane.

The systems and processes of the present disclosure accomplish this utilization of transferrable hydrogen already present in the heavy oil stream 104 by introducing the disulfide oil stream 128 to the thermal cracking system 100. As will be discussed in further detail, under reaction conditions in the thermal cracking unit 140, the disulfide oil from the disulfide oil stream 128 may react to form hydrogen sulfide ($H_2S$), which may act as a distributor of hydrogen. Not intending to be bound by any particular theory, it is believed that the disulfide compounds can abstract hydrogen molecules from hydrogen donor compounds, such as but not limited to naphthenic structures, in the heavy oil to produce $H_2S$, which then transfers the hydrogen molecules to other unsaturated hydrocarbons, resulting in capping of radicals in the reaction mixture. This can prevent further reaction, reduce excessive cracking to gas, and reduce inter-radical reactions that can lead to formation of coke and methane.

Not intending to be bound by any particular theory, the thermal cracking reaction of hydrocarbons is believed to be dominated by a radical mechanism in which the initiation step requires the highest activation energy. Chemical bond dissociation energy (BDE) of carbon-carbon bonds in aliphatic compounds is around 360-370 kilojoules/mole (kJ/mol). Beta scission of aromatic compounds having aliphatic chains has a much lower BDE (325 kJ/mol) compared to aliphatic hydrocarbons. In contrast, the sulfur-sulfur bond in disulfide compounds has a dissociation energy of from 270 kJ/mol to 280 kJ/mol, which is much less than the BDE of the carbon-carbon bonds. Table 1 provides bond dissociation energies for various chemical bonds which were obtained from Yu-ran Luo, "Handbook of Bond Dissociation Energies in Organic Compounds", CRC Press; 1 edition (Dec. 26, 2002), ISBN-10: 0849315891, ISBN-13: 978-0849315893. When the disulfide compounds are subjected to the cracking temperatures in the thermal cracking unit, the first chemical bond to be broken should be the sulfur-sulfur bonds in the disulfide compounds.

TABLE 1

Bond Dissociation Energies for Various Chemical Bonds

| Starting Compound | Scission Products | Bond Dissociation Energy (kJ/mol) |
|---|---|---|
| $CH_3—C_6H_{13}$ | $•CH_3 + •C_6H_{13}$ | 368.2 |
| $CH_3—CH_2—C_6H_{13}$ (beta scission) | $•CH_3 + •CH_2—C_6H_{13}$ | 325.1 |
| $CH_3—S—S—CH_3$ | $2 \times •S—CH_3$ | 272.8 |
| $C_2H_5—S—S—C_2H_5$ | $2 \times •S—C_2H_5$ | 276.6 |
| $H—S—C_2H_5$ | $HS• + •C_2H_5$ | 307.9 |
| $H—S—C_2H_5$ | $H• + •S—C_2H_5$ | 365.3 |

Thermal cracking of disulfide compounds having formula $R^1—S—S—R^2$, where $R^1$ and $R^2$ are alkyl groups having a number of carbon atoms less than or equal to ten, produces hydrogen sulfide ($H_2S$), thiol ($R^1$—SH, $R^2$—SH, or both), and hydrocarbons as major products. Thiol compounds having carbons more than 2, such as but not limited to ethanethiol ($C_2H_5SH$), propanethiol ($C_3H_7SH$), and butanethiol ($C_4H_9SH$), can be further cracked to produce $H_2S$ and olefins, such as but not limited to ethylene, propylene, and mixed butenes, respectively. Eventually, the products from thermal cracking of disulfide compounds include $H_2S$, thiol, olefins, and other minor compounds. The other minor compounds may include methane or elemental sulfur. The olefins may be passed out of the thermal cracking unit as a portion of the desired gaseous or liquid reaction products.

While disulfide compounds can act as initiators of radical chain reaction, $H_2S$ can also contribute to the thermal cracking of hydrocarbons. As discussed previously, $H_2S$ can act as a distributor of hydrogen. In radical reactions, the $H_2S$ can provide a hydrogen transfer function. The $H_2S$ can aid in hydrogen transfer to propagate radical reactions without being interrupted by termination reactions. The $H_2S$ can also distribute hydrogen evenly between molecules. Not intending to be bound by any particular theory, $H_2S$ can lose its hydrogen by hydrogen abstraction reaction with hydrocarbon radicals as shown in the reaction network provided in Chemical Reactions 1-4 (RXN 1-4). The resulting HS. radical is capable of abstracting hydrogen from hydrocarbons which will then become radical. Thus, $H_2S$ in a radical reaction can be understood as an agent to transfer radicals and abstract/donate hydrogen atoms.

$$R_1R_2 \rightarrow R_1. + R_2. \quad \text{RXN 1}$$

$$R_1. + H_2S \rightarrow R_1H + HS. \quad \text{RXN 2}$$

$$HS. + R_1R_2 \rightarrow R_1R_2. + H_2S \quad \text{RXN 3}$$

$$HS. + R_1. \rightarrow R_1SH \quad \text{RXN 4}$$

Referring again to FIG. 1, the thermal cracking system 100 of the present disclosure includes a thermal cracking unit 140 that thermally cracks at least a portion of the heavy oil stream 104 to produce a cracker effluent 162 and solid coke 164. The thermal cracking unit 140 may include at least one furnace 150 and at least one cracking vessel 160 downstream of the at least one furnace 150. The thermal cracking system 100 further includes the cracker effluent separation system 170 that separates the cracker effluent 162 into one or more product effluents, such as but not limited to one or more gaseous product streams 172, liquid product streams 174, or both and a cracker bottom stream 176.

Referring again to FIG. 1, the cracker effluent separation system 170 may be in fluid communication with the heavy oil stream 104 to introduce the heavy oil stream 104 directly to the cracker effluent separation system 170. The cracker effluent separation system 170 may also be in fluid communication with a fluid outlet 166 of the thermal cracking vessel 160 so that the cracker effluent 162 can be passed to the cracker effluent separation system 170. The cracker effluent 162 may be passed directly from the thermal cracking vessel 160 to the cracker effluent separation system 170 without passing through any intervening unit operations. The cracker effluent separation system 170 may be in fluid communication with the furnace 150 to pass the cracker bottom stream 176 from the cracker effluent separation system 170 to the furnace 150. In embodiments, the cracker effluent separation system 170 may be in fluid communication with a mixing unit 130 upstream of the furnace 150.

The cracker effluent separation system 170 may include one or a plurality of separation units in series or in parallel. The separation units may include distillation or fractionation units operable to separate constituents of the heavy oil feed 104, the cracker effluent 162, or both to produce a plurality of fractions based on differences in boiling point temperatures. The cracker effluent separation system 170 may be operable to separate the heavy oil feed 104, the cracker effluent 162, or both to produce at least one gaseous product stream 172, at least one liquid product stream 174, and the cracker bottom stream 176. The liquid product streams 174 may include but are not limited to a cracker naphtha stream, a cracker light gas oil stream, a cracker heavy gas oil stream, or combinations of these.

The gaseous product stream 172 may include C1-C4 hydrocarbons, hydrogen sulfide, water, carbon monoxide, carbon dioxide, any hydrogen gas produced in the thermal cracking unit 140, or other light gases having boiling point temperatures less than or equal to 30° C. C1-C4 hydrocarbons may include methane, ethane, ethene, propane, propene, n-butane, isobutene, mixed butenes, C2-C4 alkynes, or combinations of these. The gaseous product streams 172 may be passed to one or more downstream treatment processes (not shown), such as processes for recovery of fuel gas and light oils (C5-C8 oils), removal of hydrogen sulfide by alkali treatment, or other process. The cracker naphtha stream may include constituents of the cracker effluent 162, heavy oil 104, or both having boiling point temperatures in the naphtha boiling range. The liquid product stream(s) 174 (cracker naphtha stream, cracker light gas oil stream, cracker heavy oil stream, or combinations of these) may be passed to one or more downstream treatment processes (not shown), such as hydrotreating or hydrocracking, for further separation or processing.

Referring again to FIG. 1, the cracker bottom stream 176 may include constituents of the cracker effluent 162, the heavy oil stream 104, or both having boiling point temperatures of greater than or equal to 650 degrees Fahrenheit (343° C.). The cracker bottom stream 176 may include greater than 80%, greater than or equal to 90%, greater than or equal to 95%, greater than or equal to 98%, or even greater than or equal to 99% of the constituents from the cracker effluent 162, the heavy oil stream 104, or both having a boiling point temperature greater than or equal to 343° C. The cracker bottom stream 176 may be in fluid communication with the thermal cracking unit 140 to pass at least a portion of the cracker bottom stream 176 to the thermal cracking unit 140 as at least a portion of the cracker feed 132. In embodiments, the thermal cracking system 100 may further include a cracker bottoms bleed line 177, which may be operable to pass a portion of the cracker bottom stream 176 out of the thermal cracking system 100 to reduce buildup of unconvertable compounds and contaminants in the thermal cracking system 100.

The disulfide oil stream 128 may be combined with the cracker bottom stream 176 upstream of the thermal cracking unit 140. The disulfide oil stream 128 may be in fluid communication with the cracker bottom stream 176 to pass the disulfide oil stream 128 directly into contact with the cracker bottom stream 176 to produce the cracker feed 132. The thermal cracking system 100 may further include a mixing unit 130 operable to receive the disulfide oil stream 128 and the cracker bottom stream 176 and mix the disulfide oil 128 and the cracker bottom stream 176 to produce the cracker feed 132. In embodiments, the disulfide oil stream 128 may be combined with the cracker bottom stream 176 upstream of the mixing unit 130 and then passed to the mixing unit 130. The mixing unit 130 may be any commercially-available mixing device operable to mix the disulfide oil stream 128 and cracker bottom stream 176. In embodiments, the mixing unit 130 may be a static mixer.

Referring again to FIG. 1, the thermal cracking unit 140 can include at least one furnace 150 and at least one cracking vessel 160 downstream of the furnace 150. The thermal cracking unit 140 may be operable to thermally crack at least a portion of the cracker bottom stream 176, the disulfide oil stream 128, or both to produce the cracker effluent 162, which may comprise one or more gaseous reaction products, liquid reactions products, or combinations of these. The thermal cracking unit 140 may further be operable to produce solid coke 164. The thermal cracking unit 140 may be a delayed coker process or a visbreaker process.

Referring to FIG. 1, at least a portion of the cracker bottom stream 176 may be combined with the disulfide oil stream 128 upstream of the furnace 150 to produce the cracker feed 132. Additionally or alternatively, the disulfide oil stream 128 and the cracker bottom stream 176 may each be passed separately to the furnace 150, where they may be combined and mixed within the furnace 150 to form the cracker feed 132. The furnace 150 may be a gas fired heater or a fuel oil fired heater. The furnace 150 may include a single furnace or a plurality of furnaces operated in parallel or in series. The furnace 150 may be operable to heat the cracker feed 132 to a cracking temperature sufficient to crack at least a portion of the hydrocarbons from the cracker feed 132. The cracking temperature may be from 450° C. to 600° C. The residence time of the cracker feed 132 in the furnace 150 may be sufficient to heat the cracker feed 132 to the target cracking temperature (450° C. to 600° C.) and may depend on the properties of the cracker feed 132, the tube sizes in the furnace 150, and internal structure of the furnace 150 and other known parameters such as the number of burner tips etc. The residence time of the cracker feed 132 in the furnace 150 may be from 1 minute to 60 minutes.

Referring again to FIG. 1, the furnace 150 may be in direct fluid communication with an inlet of the at least one cracking vessel 160 to pass the heated cracker feed 152 directly from the furnace 150 to the cracking vessel(s) 160. The cracking vessel(s) 160 may be operable to maintain the heated cracker feed 152 at the cracking temperature to crack at least a portion of the heated cracker feed 152 to produce the cracker effluent 162 and the solid coke 164. The thermal cracking unit may include a plurality of cracking vessels 160, which may be operated in parallel. When the thermal cracking unit 140 is a delayed coker process, the cracking vessel 160 may be a coker drum. The fluid outlet 166 of the cracking vessel 160 may be in fluid communication with the cracker effluent separation system 170 to pass the cracker effluent 162 directly to the cracker effluent separation system 170.

Referring again to FIG. 1, operation of the thermal cracking system 100 will now be described in further detail. During operation of the thermal cracking system 100, the heavy oil stream 104 may be passed to the thermal cracking system 100. In particular, the heavy oil stream 104 may be introduced to the cracker effluent separation system 170. The heavy oil stream 104 may be introduced through a feed pump upstream of the cracker effluent separation system 170 at a pressure of from 10 pounds of force per square inch gauge (psig) (69 kilopascals (kPa)) to 100 psig (690 kPa). Due to the greater viscosity of the heavy oil stream 104, the heavy oil stream 104 may be maintained at a temperature of from 100° C. to 400° C. in order for the heavy oil stream 104 to flow through the pump.

The cracker effluent separation system 170 also receives the cracker effluent 162 from the cracking vessel 160. The cracker effluent separation system 170 may separate the cracker effluent 162, along with the heavy oil stream 104, into the one or more product streams and the cracker bottom stream 176. Passing the heavy oil stream 104 to the cracker effluent separation system 170 may be intended to assist in recycling unreacted residue fractions from the cracker effluent 162 back to the thermal cracking unit 140 by providing additional volume flow of greater density constituents through the cracker effluent separation system 170. The cracker bottom stream 176 passed out of the cracker effluent separation system 170 may have a temperature of from 300° C. to 500° C. and a pressure of from 10 psig (69 kPa) to 50 psig (345 kPa).

Referring to FIG. 1, the cracker bottom stream 176 may be passed from the cracker effluent separation system 170 to the furnace 150 of the thermal cracking unit 140 using a transfer pump 190 that may increase the pressure of the cracker bottom stream 176 to a pressure of from 150 psig (1034 kPa) to 400 psig (2758 kPa). The increased pressure may compensate for additional pressure drop in the furnace 150 and cracking vessel 160. A portion of the cracker bottom stream 176 may be passed out of the thermal cracking system 100 through the cracker bottoms bleed line 177. The portion of the cracker bottom stream 176 passed out of the system in the cracker bottoms bleed line 177 may be passed to storage (not shown).

The disulfide oil stream 128 may be passed to the thermal cracking system 100 and combined with the cracker bottom stream 176 upstream of the furnace 150 to produce the cracker feed 132. The disulfide oil stream 128 may have a temperature of from 10° C. to 100° C. and a pressure of from 150 psig (1034 kPa) to 400 psig (2758 kPa). The disulfide oil stream 128 and the cracker bottom stream 176 may be mixed to produce the cracker feed 132. The mixing may be accomplished by passing the disulfide oil stream 128 and the cracker bottom stream 176 to the mixing unit 130 disposed upstream of the thermal cracking unit 140.

The mass flow rate of the disulfide oil stream 128 may be determined based on the sulfur contents of the disulfide oil stream 128 and the heavy oil stream 104. The sulfur content of the disulfide oil stream 128 should be greater than a sulfur content of the cracker bottom stream 176, the heavy oil stream 104, or both. In particular, the sulfur content of the disulfide oil stream 128 may be greater than a sulfur content of the cracker bottom stream 176 by from 1% to 35%. The amount of the disulfide oil stream 128 passed to the thermal cracking unit 140, such as by combining the disulfide oil stream 128 with the cracker bottom stream 176, may be sufficient to increase the total sulfur content in the thermal cracking unit 140 by at least 3%, by at least 5%, or by at least by 7% compared to operation of the thermal cracking unit 140 without the disulfide oil stream 128.

The cracker feed 132 may include an amount of the disulfide oil stream 128 sufficient to promote formation of gaseous and liquid reaction products in the thermal cracking unit 140. The cracker feed 132 may include greater than or equal to 0.5 wt. %, greater than or equal to 1 wt. %, or greater than or equal to 3 wt. % disulfide oil stream 128 based on the total weight of the cracker feed 132. When the amount of the disulfide oil stream 128 in the cracker feed 132 is less than 0.5 wt. %, the amount of disulfide oil may not be sufficient to promote the formation of gaseous and liquid reaction products over solid coke. The cracker feed 132 may include less than or equal to 30 wt. %, less than or equal to 20 wt. %, less than or equal to 15 wt. %, or even less than or equal to 10 wt. % disulfide oil stream 128 based on the total weight of the cracker feed 132. When the amount of the disulfide oil stream 128 in the cracker feed 132 is greater than 30 wt. %, the excess disulfide oil may reduce the efficiency of the furnace 150 by creating greater amounts of gases within the furnace coil, which may reduce heating efficiency. The cracker feed 132 may include from 0.5 wt. % to 30 wt. %, from 0.5 wt. % to 20 wt. %, from 0.5 wt. % to 15 wt. %, from 0.5 wt. % to 10 wt. %, from 1 wt. % to 30 wt. %, from 1 wt. % to 20 wt. %, from 1 wt. % to 15 wt. %, from 1 wt. % to 10 wt. %, from 3 wt. % to 30 wt. %, from 3 wt. % to 20 wt. %, from 3 wt. % to 15 wt. %, from 3 wt. % to 10 wt. %, or from 10 wt. % to 30 wt. % of the disulfide oil stream 128 based on the total weight of the cracker feed 132. The mass flow ratio of the disulfide oil stream 128 to the cracker bottom stream 176 may be from 0.005 to 0.430, where the mass flow ratio is the mass flow rate of the disulfide oil stream 128 divided by the mass flow rate of the cracker bottom stream 176.

The cracker feed 132 may have a temperature of from 250° C. to 450° C. and a pressure of from 150 psig (1034 kPa) to 400 psig (2758 kPa). Referring again to FIG. 1, the cracker feed 132 may be passed to the thermal cracking unit 140. In particular, the cracker feed 132 may be passed to the furnace 150. The furnace 150 may heat the cracker feed 132 to produce a heated cracker feed 152 having a cracking temperature sufficient to crack at least a portion of the hydrocarbons in the heated cracker feed 152. The heated cracker feed may have a temperature of from 450° C. to 600° C. and a pressure of from 80 psig (552 kPa) to 300 psig (2068 kPa). The residence time of the cracker feed 132 in the furnace 150 may be from 1 minute to 60 minutes.

The heated cracker feed 152 may then be passed from the furnace 150 to the cracking vessel 160 where the cracking reactions continue to convert heavy hydrocarbons in the heated cracker feed 152 into greater value gaseous reaction products, greater value liquid reaction products, and solid coke. The gaseous reaction products and liquid reaction products, as well as any unreacted hydrocarbons and light gases, may be passed out of the cracking vessel 160 in the cracker effluent 162. Thermal cracking of the heated cracker feed 152 in the cracking vessel 160 also produces the solid coke 164. Additionally, the disulfide oil from the disulfide oil stream 128 may undergo decomposition at the temperatures in the furnace 150 and in the cracking vessel 160 to produce $H_2S$, thiol (R—SH), and olefins as previously discussed. The olefins may pass out of the cracking vessel 160 as one of the greater value gaseous or liquid reaction products in the cracker effluent 162. Radicals generated from the decomposition of the disulfide oil may contribute to the conversion of hydrocarbons from the cracker bottom stream 176 to the greater value gaseous and liquid reaction products. Thus, the presence of the disulfide oil from the disulfide oil stream 128 may reduce formation of the solid coke 164 and increase yields of the liquid reaction products, the gaseous reaction products, or both compared to operation of the thermal cracking unit 140 without the disulfide oil stream 128.

The residence time of the heated cracker feed 152 in the cracking vessel 160 may depend on the type of coke produced, the operating conditions (temperature, pressure) of the cracking vessel 160, and the properties of the heated cracker feed 152. As the cracking reactions proceed in the cracking vessel 160, solid coke formed by the cracking reactions may deposit and collect in the interior of the cracking vessel 160. The cracking vessel 160 may be operated until the buildup of solid coke in the cracking vessel 160 adversely effects conversion and yield in the cracking vessel 160. At his point, the cracking vessel 160 may be taken off-line for removal of the solid coke 164 from the cracking vessel 160. A run length for the cracking vessel 160 can be from 12 hours to 96 hours, where the run length is the length of time that the cracking vessel 160 operates between off-line periods to remove the solid coke 164. As previously discussed, the thermal cracking unit 140 may include a plurality of cracking vessels 160 operated in parallel to maintain continuous operation of the thermal cracking unit 140. With a plurality of cracking vessels 160, the run length of each cracking vessel 160 can be staggered so that when one cracking vessel 160 is taken off-line for removal of solid coke 164, the other cracking vessels 160 continue operation.

Referring again to FIG. 1, the cracker effluent 162 may be passed out of the cracking vessel 160 at a temperature of from 430° C. to 550° C. and a pressure of from 10 psig (69 kPa) to 280 psig (1931 kPa). The cracker effluent 162 may include the gaseous reactions products, the liquid reaction products, underreacted hydrocarbons, light inorganic gases, and combinations of these. Light inorganic gases may include, but are not limited, to $H_2S$, hydrogen, carbon monoxide, carbon dioxide, water vapor, other inorganic gases, and combinations of these. The underreacted hydrocarbons may refer to unreacted hydrocarbons that did not undergo thermal cracking or hydrocarbons that underwent insufficient thermal cracking in the thermal cracking unit. Insufficient thermal cracking may refer to a degree of thermal cracking that changes the hydrocarbon molecule but does not convert the hydrocarbon molecule into greater value gaseous or liquid reaction products. An example would be breaking an asphaltene compound into two smaller polyaromatic compounds that pass out of the cracking vessel in the cracking effluent 162 but are not greater value petrochemical products and would be better suited to passing back through the thermal cracking unit or purged from the system.

Figure 5:
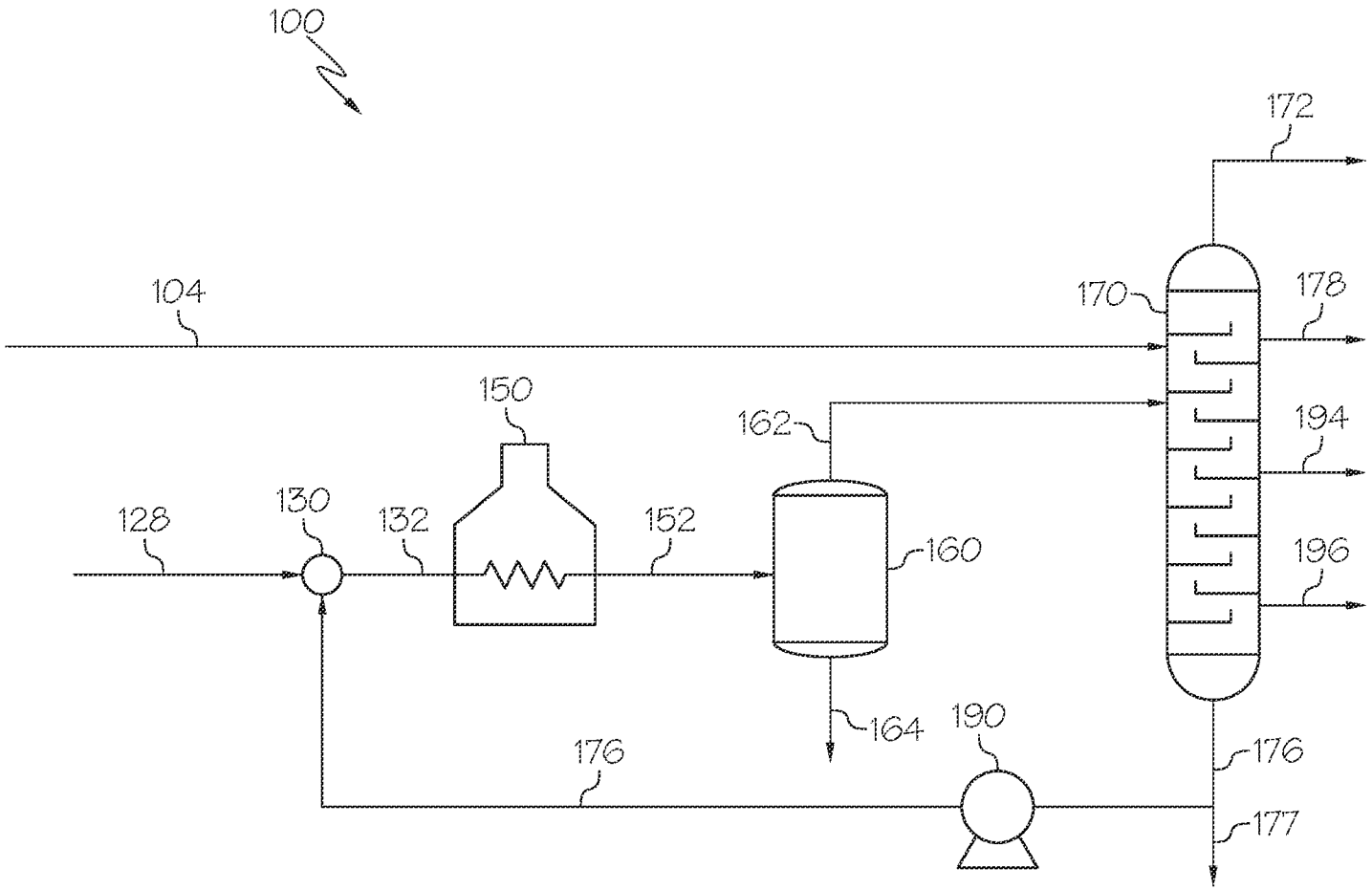
FIG. 5 schematically depicts a generalized flow diagram of another process for upgrading heavy oils that is modeled in the Examples, according to one or more aspects shown and described in the present disclosure.

The cracker effluent 162 may be passed from the cracking vessel 160 to the cracker effluent separation system 170. The cracker effluent separation system 170 may separate the cracker effluent 162 into the gaseous product stream 172, at least one liquid product stream 174, and the cracker bottom stream 176. The cracker effluent separation system 170 may separate the liquid reaction products into a plurality of liquid product streams, such as but not limited to a cracker naphtha stream 178, a cracker light gas oil 194, and a cracker heavy gas oil 196, as shown in FIG. 5. The gaseous product stream 172 may have a temperature of from 90° C. to 150° C. and a pressure of from 10 psig to 50 psig. The gaseous product stream 172 may be passed to one or more downstream treatment processes for removal of $H_2S$ and recovery of fuel gases (C1-C4 hydrocarbons). The liquid product streams 174 may have temperatures ranging from 100° C. to 500° C. and pressures of from 10 psig to 50 psig. The liquid product streams 174 may also be passed to downstream treatment systems for further processing, such as hydrotreating, to further upgrade the liquid reaction products.

Referring again to FIG. 1, the solid coke 164 may be removed from the cracking vessel 160 of the thermal cracking unit 140 at periodic intervals. The solid coke 164 recovered from the cracking vessel 160 may be further processed to produce various types of solid coke such as short coke and needle coke. As used in the application, "anode coke", "fuel coke", and "needle coke" are defined by the ranges and properties provided in the following Table 2. Fuel grade coke, which generally has greater than 3.5 weight (wt.) % of sulfur and 650 ppm of metals (Ni+V), and anode coke, which generally has less than 3.5 wt. % sulfur and 450 ppm of metals, are often distinguished based on the sulfur and metals content in the respective cokes. Passing the disulfide oil stream 128 to the thermal cracking system 100 may increase the yield of high-grade coke such as anode grade coke, or may reduce impurities in the coke produced by the thermal cracking unit 140 compared to operating the thermal cracking unit 140 without the disulfide oil stream 128.

TABLE 2

Properties of Grades of Solid Coke

| Property | Units | Fuel Coke | Anode Coke | Needle Coke |
|---|---|---|---|---|
| Bulk Density | Kilograms per cubic meter ($Kg/m^3$) | 750-880 | 720-800 | 670-720 |
| Sulfur | wt. % | 3.5-7.5 | 1.0-3.5 | 0.2-0.5 |
| Nitrogen | Parts per million | ~6,000 | — | ~50 |

TABLE 2-continued

Properties of Grades of Solid Coke

| Property | Units | Fuel Coke | Anode Coke | Needle Coke |
|---|---|---|---|---|
| | by weight (ppmw) | | | |
| Nickel | ppmw | ~500 | <200 | 7 max |
| Vanadium | ppmw | ~150 | <150 | — |
| Volatile Combustible Material | wt. % | ~12 | ~0.5 | ~0.5 |
| Ash Content | wt. % | 0.1-0.3 | 0.1-0.3 | ~0.1 |
| Moisture Content | | 8-12 | 0.1-0.5 | ~0.1 |
| Hardgrove Grindability Index (HGI) | wt. % | 35-70 | 60-100 | — |
| Coefficient of thermal expansion, E + 7 | ° C. | — | — | 1-5 |

Figure 2:
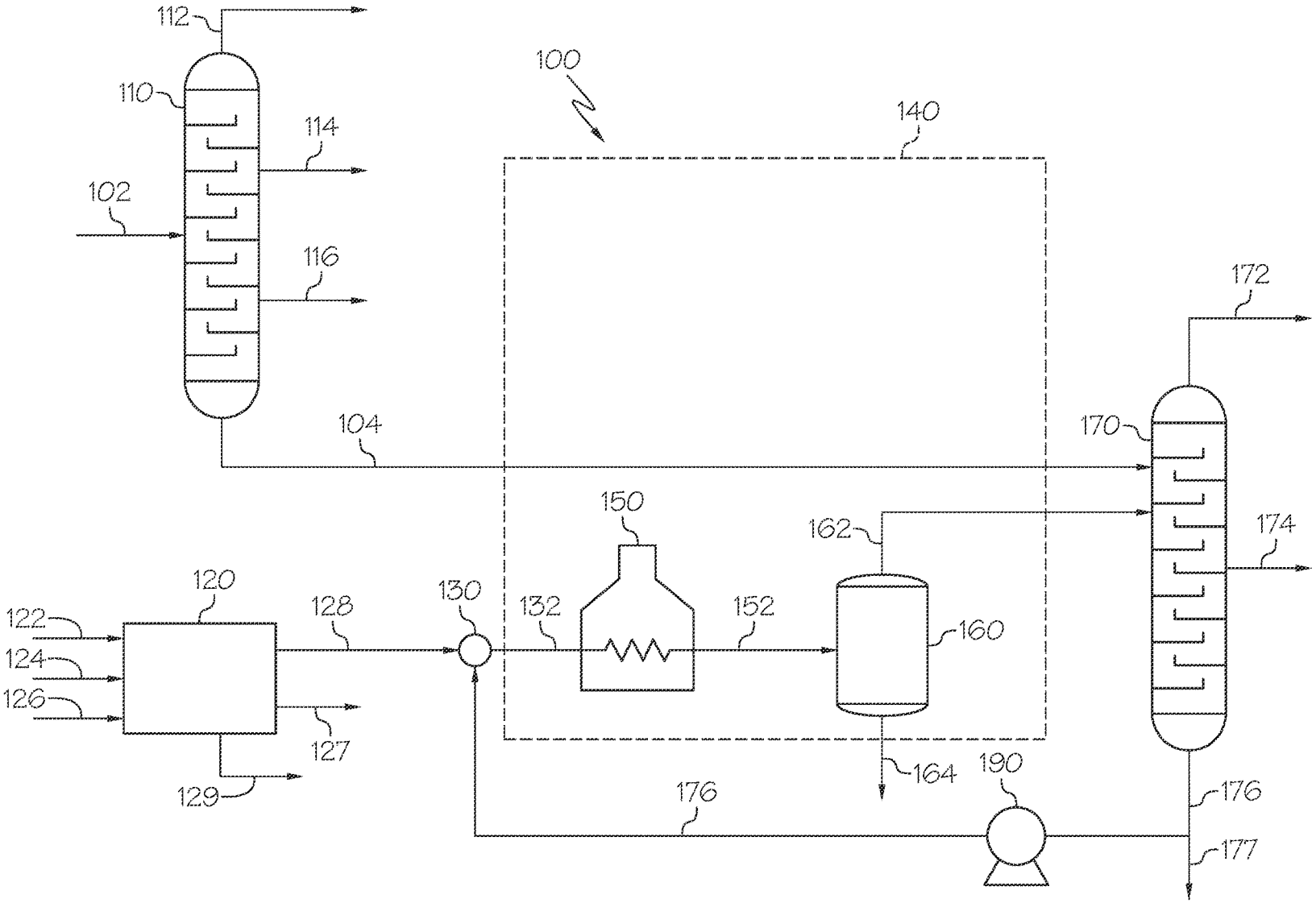
FIG. 2 schematically depicts a generalized flow diagram of another process for upgrading heavy oils, according to one or more aspects shown and described in the present disclosure.

Referring now to FIG. 2, the thermal cracking system 100 may include a distillation system 110 disposed upstream of the cracker effluent separation system 170 and the thermal cracking unit 140. The distillation system 110 may be operable to separate a hydrocarbon feed 102 to produce at least one distillation fraction and a distillation residue, which may be passed to the thermal cracking unit 140 as the heavy oil stream 104. The distillation fractions may include but are not limited to a light gas fraction 112, a naphtha distillation fraction 114, a gas oil distillation fraction 116, or combinations of these. Other distillation fractions are contemplated.

As previously discussed, the hydrocarbon feed 102 to the distillation system 110 may be derived from petroleum, coal liquid, waste plastics, biomaterials, or combinations of these. In particular, the hydrocarbon feed may include one or more of crude oil, distilled crude oil, residue oil, topped crude oil, product streams from oil refineries, product streams from steam cracking processes, liquefied coals, liquids recovered from oil or tar sands, bitumen, shale oil, asphaltenes, biomass hydrocarbons, or combinations of these. The hydrocarbon feed 102 may comprise a raw oil source, such as crude oil that has not been previously processed, or an oil source that has undergone some degree of processing, such as desalting or water separation, prior to being introduced to the distillation system 110 as the hydrocarbon feed 102.

The distillation system 110 may include one or a plurality of distillation units, fractionation columns, or both. The distillation system 110 may include distillation units operated at atmospheric pressure, distillation units operated under vacuum, or a combination of these. In embodiments, the distillation system 110 is an atmospheric distillation system and the heavy oil stream 104 is the atmospheric residue produced from the atmospheric distillation system. In embodiments, the distillation system 110 includes a vacuum distillation unit and the heavy oil stream 104 is the vacuum residue produced by the vacuum distillation unit. In embodiments, the distillation system 110 may include an atmospheric distillation unit and a vacuum distillation unit downstream of the atmospheric distillation. In these embodiments, the vacuum distillation unit may receive the atmospheric residue from the atmospheric distillation unit and separate the atmospheric residue into one or more vacuum gas oil effluents and the vacuum residue. The vacuum residue may be passed to the thermal cracking unit 140 or cracker effluent separation system 170 as the heavy oil stream 104.

The distillation system 110 may be in fluid communication with the cracker effluent separation system 170 to pass the heavy oil stream 104 directly from the distillation system 110 to the cracker effluent separation system 170. Alternatively or additionally, the distillation system 110 may be in fluid communication with the thermal cracking unit 140 to pass at least a portion of the heavy oil stream 104 directly to the thermal cracking unit 140, such as to the furnace 150 of the thermal cracking unit 130. The heavy oil stream 104 may be passed through a heat exchanger (not shown) upstream of the cracker effluent separation system 170, the thermal cracking unit 140, or both to increase the temperature of the heavy oil stream 104 to 100° C. to 400° C. The temperature of the heavy oil stream 104 may be maintained at a temperature of greater than or equal to 100° C. to allow the heavy oil stream 104 to be pumped. The heavy oil stream 104 may also be passed through a pump (not shown) to increase the pressure to from 10 psig to 100 psig.

Referring again to FIG. 2, the thermal cracking system 100 may further include a sweetening process 120 disposed upstream of the thermal cracking unit 140. The sweetening process 120 may be operable to treat a sulfur-containing hydrocarbon stream 122 to remove sulfur compounds, such as mercaptan compounds, from the sulfur-containing hydrocarbon stream 122 to produce at least a reduced-sulfur hydrocarbon stream 127 and the disulfide oil stream 128. The sweetening process 120 may be in fluid communication with the thermal cracking unit 140, the mixing unit 130, the cracker bottom stream 176, or combinations of these to pass the disulfide oil stream 128 from the sweetening process 120 to the thermal cracking unit 140, the mixing unit 130, the cracker bottom stream 176, or combinations of these, respectively. In embodiments, the disulfide oil stream 128 may be passed directly from the sweetening process 120 to the thermal cracking unit 140, the mixing unit 130, the cracker bottom stream 176, or combinations of these.

The sweetening process 120 may be a mercaptan oxidation (MEROX) process. The MEROX process may be operable to convert mercaptans in a mercaptan-containing hydrocarbon stream to one or more disulfides and separate the disulfides from a MEROX effluent to produce the disulfide oil stream 128. The mercaptans in the mercaptan-containing hydrocarbon stream may be converted to disulfides through oxidation. The MEROX process in all of its applications is based on the ability of an organometallic catalyst to accelerate the oxidation of mercaptans to disulfides at near ambient temperatures and pressures. The overall reaction for conversion of mercaptans to disulfides through oxidation is provided in the following Chemical Reaction 5 (RXN 5):

$$2R^3SH+2R^4SH+O_2 \rightarrow 2R^3SSR^4+2H_2O \quad \text{(RXN 5)}$$

In RXN 5, $R^3$ and $R^4$ are each a hydrocarbon group that may be straight, branched, or cyclic. The hydrocarbon chains of $R^3$ and $R^4$ may be saturated or unsaturated and may include 1, 2, 3, 4, 5, 6, 7, 8, 9, or 10 carbon atoms. Most petroleum fractions containing mercaptans may contain a mixture of mercaptans having different numbers of carbon atoms in the R group. Thus, $R^3$ and $R^4$ may be the same or different hydrocarbon groups having the same or different numbers of carbon atoms.

The oxidation reactions of mercaptans occur spontaneously, but at a very slow rate, whenever any sour mercaptans bearing distillate is exposed to atmospheric oxygen. In addition, mercaptan oxidation according to RXN 5 may require the presence of an alkaline solution, such as sodium hydroxide (caustic), ammonia, or other alkaline solution, to proceed at economically practical rates at moderate refinery run downstream temperatures. In the MEROX process, an oxygen-containing stream, such as air, and an alkaline solution, such as caustic, are passed to the MEROX process in addition to the sulfur-containing hydrocarbon stream. When caustic is used as the alkaline solution, mercaptans in the sulfur-containing hydrocarbon stream react with the caustic to produce NaSR according to the following Chemical Reaction 6 (RXN 6).

$$R^3SH+R^4SH+2NaOH \rightarrow NaSR^3+NaSR^4+2H_2O \quad \text{(RXN 6)}$$

The resulting mercaptan salts ($NaSR^3$ and $NaSR^4$) are extracted from the oil phase to the aqueous phase. The $NaSR^3$ and $NaSR^4$ are then reacted with oxygen according to Chemical Reaction 7 (RXN 7) to produce caustic and disulfides, which are water insoluble.

$$2NaSR^3+2NaSR^4+O_2+2H_2O \rightarrow 2R^3SSR^4+4NaOH \quad \text{(RXN 7)}$$

In RXN 6 and RXN 7, R3 and R4 can be any hydrocarbon groups having from 1 to 10 carbon atoms and can be the same or different. The caustic (NaOH) can be separated from the disulfide oil and recycled back to the process or discharged from the MEROX process in aqueous waste stream 129 in FIG. 2.

There are two types of MEROX processes: one for liquid hydrocarbon streams and the second for hydrocarbon streams comprising a combination of gases and liquids. In the liquid MEROX process, the mercaptans present in liquid mercaptan-containing hydrocarbon stream can be converted directly to disulfides, which remain in the product, and there is no reduction in total sulfur content. Because the vapor pressures of disulfides are very low relative to those of mercaptans, the presence of disulfides is much less objectionable. However, the disulfides are not environmentally acceptable and may be difficult to dispose or treat. The liquid MEROX process may utilize a fixed bed reactor system and may be suitable for charge stocks having end boiling points above 135° C. to 150° C. Mercaptans may be converted to disulfides in a fixed bed reactor system over a catalyst, for example, an activated charcoal impregnated with MEROX reagent, and wetted with an alkaline solution, such as a caustic solution. Air or other oxygen-containing gas may be injected into the mercaptan-containing hydrocarbon stream upstream of the MEROX reactor and in passing through the catalyst-impregnated bed, at least a portion of the mercaptans in the mercaptan-containing hydrocarbon stream may be oxidized to disulfides. The disulfides are generally caustic insoluble and remain in the hydrocarbon phase. The MEROX effluent may be treated downstream of the MEROX reactor to remove undesirable by-products due to side reactions such as the neutralization of $H_2S$, oxidation of phenolic compounds, entrained caustic, or other side reactions, to produce a disulfide oil effluent. MEROX processes for mercaptan-containing streams comprising a combination of gases and liquids may include extraction of the mercaptans. Extraction may be applied to both gaseous and liquid hydrocarbon streams. The degree of completeness of mercaptans extraction depends upon the solubility of mercaptans in the alkaline solution. The mercaptans removal may be a function of molecular weight of mercaptans, degree of branching of the mercaptan molecules, caustic soda concentration, and temperature of the system.

Referring again to FIG. 2, when the sweetening process 120 is a MEROX process, the sulfur-containing hydrocarbon stream 122 may be contacted with the oxygen-containing stream 124 and the alkaline stream 126 in the presence of the MEROX catalyst (not shown) to produce a MEROX effluent, which is then separated into a reduced-sulfur hydrocarbon stream 127 and the disulfide oil stream 128. The sweetening process 120 may also produce a recovered caustic stream 129, which may be passed out of the system or recycled back to the sweetening process 120 as at least a portion of the alkaline stream 126. The sulfur-containing hydrocarbon stream 122 may be natural gas, liquefied petroleum gas (LPG), naphtha, or combinations of these. The disulfide oil stream 128 may have any of the compositions, properties or characteristics previously described in the present disclosure for the disulfide oil stream 128.

Figure 3:
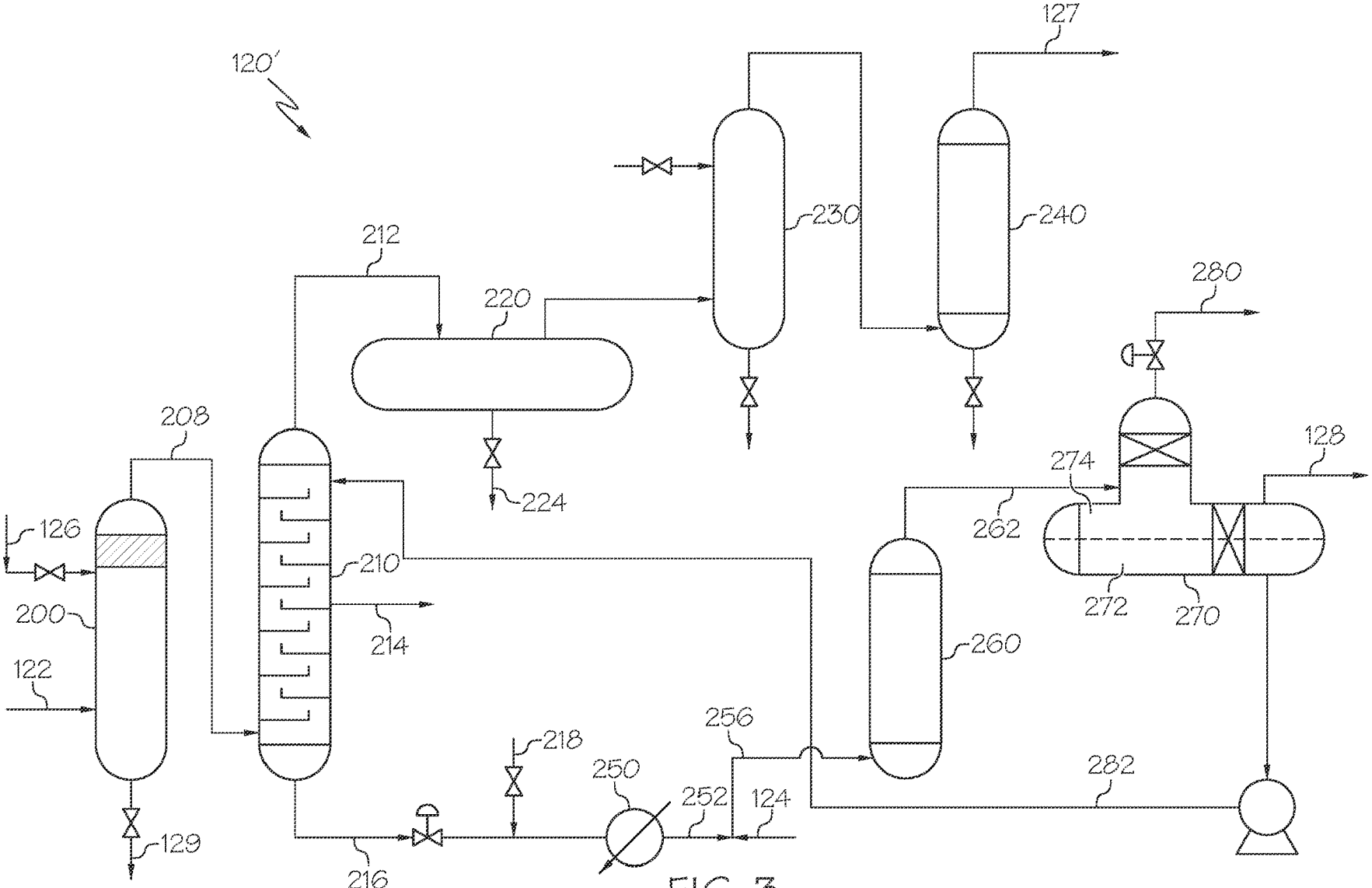
FIG. 3 schematically depicts a generalized flow diagram of a sweetening process unit of the process in FIG. 1, according to one or more aspects shown and described in the present disclosure.

Referring to FIG. 3, a typical MEROX process 120' is schematically depicted. The MEROX process 120' may include a caustic prewash unit 200 operable to contact the sulfur-containing hydrocarbon stream 122 with the alkaline solution 126, such as caustic, to produce a prewashed hydrocarbon stream 208. The prewashed hydrocarbon stream 208 may be passed to a mercaptan extraction unit 210 operable to contact the prewashed hydrocarbon stream 208 with a lean alkaline solution (caustic) 282 to produce a sweetened hydrocarbon stream 212 and a rich alkaline solution 216 comprising mercaptan salts dissolved in the alkaline solution. RXN 6 may occur in the mercaptan extraction unit 210 to convert the mercaptan compounds to mercaptan salts, which then are solubilized in the aqueous phase. The sweetened hydrocarbon stream 212 may be further processed in a caustic settler 220, a water wash process 230 and a salt bed 240 to remove any residual alkaline solution 126 to produce the reduced-sulfur hydrocarbon stream 127.

The rich alkaline solution 216 comprising the mercaptan salts may be combined with MEROX catalyst 218 and the oxygen-containing stream 124 and then preheated to produce an oxidizer feed 256. The oxidizer feed 256 is then passed to an oxidizer unit 260 in which RXN 7 may occur to convert the mercaptan salts to disulfides to produce the MEROX effluent 262. The MEROX effluent 262 is then passed to a MEROX separator 270, which can be a phase separator that separates the MEROX effluent 262 into an aqueous layer 272 and a hydrocarbon layer 274. Gases 280 such as excess oxygen-containing gases, may be vented from the MEROX separator 270. The aqueous layer 272 can be drawn out of the MEROX separator 270 and passed back to the mercaptan extraction unit 210 as the lean alkaline solution 282. The hydrocarbon layer 274 can be drawn off as the disulfide oil stream 128, which can then be passed to the thermal cracking unit 140.

In general, MEROX process 120' removes sulfur from natural gas, LPG, and naphtha. Mercaptans present in hydrocarbon streams boiling in the diesel range or heavier, cannot be treated by the MEROX process, because these greater boiling hydrocarbon streams have very low miscibility with caustic solutions, which limits the transfer of the mercaptan salts into the aqueous phase during the process. Thus, the disulfide oil stream 128 passed to the thermal cracking unit 140 may be a disulfide oil stream 128 produced from sweetening of a sulfur-containing hydrocarbon stream 122 that comprises natural gas, liquefied petroleum gas (LPG), naphtha, or combinations of these.

Figure 4:
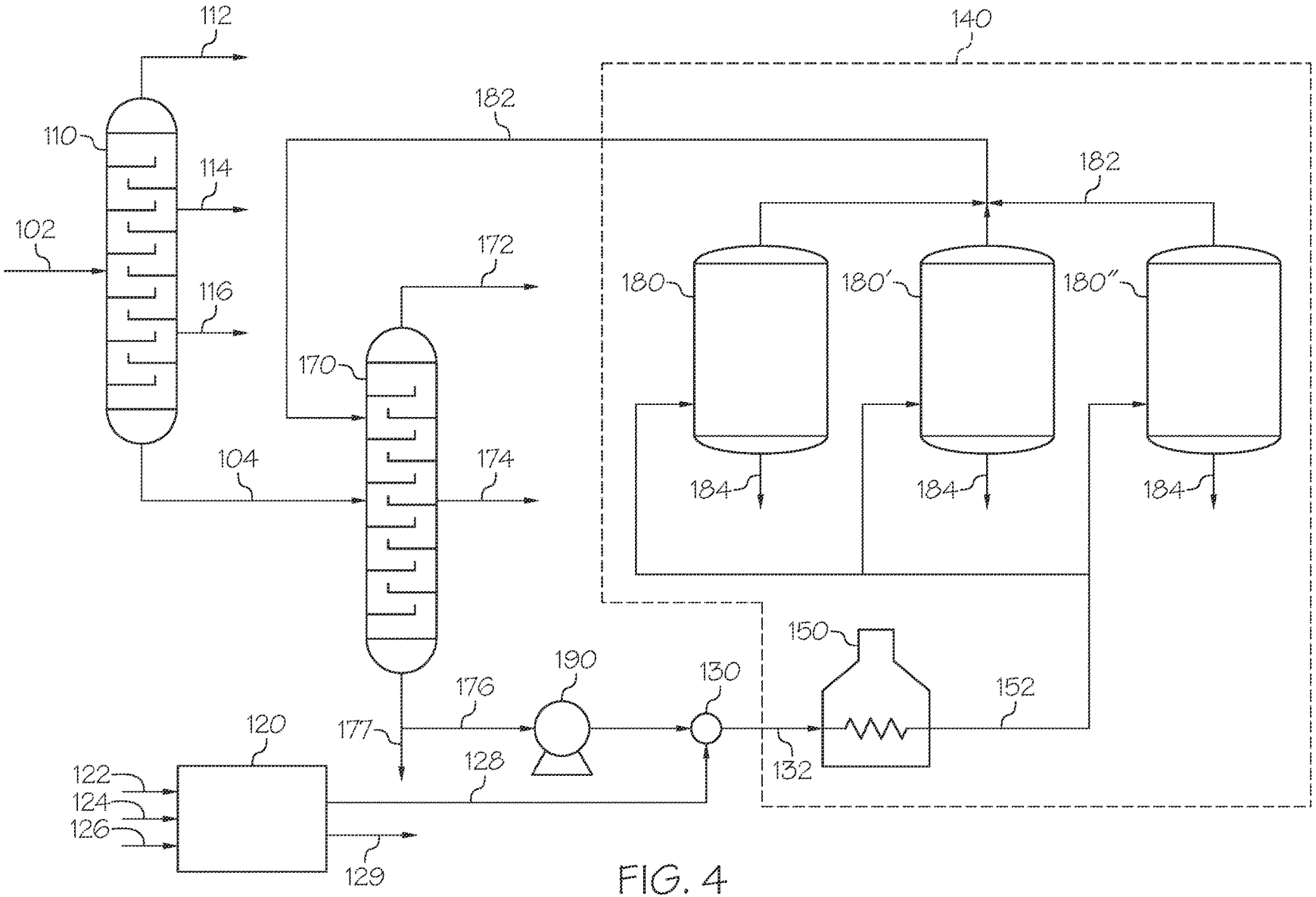
FIG. 4 schematically depicts a generalized flow diagram of another process for upgrading heavy oils where the thermal cracking system comprises a delayed coker, according to one or more aspects shown and described in the present disclosure.

Referring now to FIG. 4, as previously discussed, the thermal cracking unit 140 may be a delayed coker unit having the furnace 150 and a plurality of coker drums, such as a first coker drum 180, a second coker drum 180', and a third coker drum 180". The first coker drum 180, the second coker drum 180', and the third coker drum 180" may be operated in parallel to maintain continuous operation of the thermal cracking unit 140. In FIG. 4, operation of the distillation system 110, the sweetening process 120, the cracker effluent separation system 170, and the furnace 150 may be the same as previously described in the present disclosure for these units. Additionally, the disulfide oil stream 128, hydrocarbon feed 102, heavy oil stream 104, cracker bottom stream 176, cracker feed 132, and the heated cracker feed 152 may have any of the compositions, properties, or characteristics previously discussed for these streams. As shown in FIG. 4, the heated cracker feed 152 may be passed from the furnace 150 to each of the first coker drum 180, the second coker drum 180', and the third coker drum 180". The first coker drum 180, the second coker drum 180', and the third coker drum 180" may operate to maintain the heated cracker feed 152 at the cracker temperature to crack at least a portion of the hydrocarbons from the heated cracker feed 152 to produce a coker effluent 182 and solid coke 184, where the coker effluent 182 comprises the liquid reaction products, gaseous reaction products, or both produced by the cracking reactions.

Each of the first coker drum 180, the second coker drum 180', and the third coker drum 180" may be periodically taken off-line for removal of the solid coke 184 from the drum. Operations of the first coker drum 180, the second coker drum 180', and the third coker drum 180" may be staggered to maintain continuous operation of the thermal cracking unit 140 to produce a continuous stream of the coker effluent 182. The thermal cracking unit 140 may be operated such that the second coker drum 180' and the third coker drum 180" operate to conduct cracking reactions while the first coker drum 180 is taken off-line for removal of the solid coke 184 from the first coker drum 180. Once the first coker drum 180 is returned to operation, the second coker drum 180' may be taken off-line for removal of solid coke 184 from the second coker drum 180' while the first coker drum 180 and third coker drum 180" continue to operate. Once the second coker drum 180' is returned to operation, the third coker drum 180" may be taken off-line for removal of the solid coke 184 from the third coker drum 180" while the first coker drum 180 and second coker drum 180' continue to operate. Although schematically depicted in FIG. 4 as having 3 coker drums, it is understood that the thermal cracking system 140 may have less than 3 coker drums (such as 1 or 2 coker drums) or more than 3 coker drums (such as 4, 5, 6, or more than 6 coker drums).

Referring again to FIGS. 1 and 2, processes for upgrading a heavy oil using the thermal cracking system 100 of the present disclosure will now be discussed. The processes for upgrading heavy oil may include passing heavy oil and disulfide oil to the thermal cracking system 100, which may comprise the thermal cracking unit 140 and the cracker effluent separation system 170 downstream of the thermal cracking unit 140. The heavy oil may be passed to the thermal cracking system 100 in the heavy oil stream 104. The disulfide oil may be passed to the thermal cracking system 100 through the disulfide oil stream 128. The processes may further include thermally cracking at least a portion of the heavy oil from the heavy oil stream 104 in the presence of the disulfide oil from the disulfide oil stream 128 in the thermal cracking unit 140 to produce solid coke 164 and the cracking effluent 162 comprising one or more reaction products. The reaction products may include one or more liquid reaction products, one or more gaseous reaction products, or both. The presence of the disulfide oil from the disulfide oil stream 128 may promote conversion of hydrocarbons from the heavy oil stream 104 to the liquid reaction products, the gaseous reaction products, or both instead of solid coke. In embodiments, the presence of the disulfide oil may suppress formation of solid coke 164 in the thermal cracking unit 140. The presence of the disulfide oil in the thermal cracking system 100 may further increase the yield of high-grade coke such as anode grade coke, or may reduce impurities in the solid coke 164 produced by the thermal cracking system compared to operation of the thermal cracking system 100 under the same conditions but without the disulfide oil. The thermal cracking unit 140 may include a delayed coker, a visbreaker, or combinations of these.

The heavy oil stream 104 may include a heavy oil having any of the compositions, properties, or characteristics previously described in the present disclosure for the heavy oil. In embodiments, the heavy oil of the heavy oil stream 104 is a residue from distillation of a hydrocarbon feed. The residue may be an atmospheric residue from atmospheric distillation of the hydrocarbon feed, a vacuum residue from distillation of the hydrocarbon feed under vacuum, or a combination of these. In embodiments, the heavy oil of the heavy oil stream 104 may have an API gravity less than or equal to 16 or less than or equal to 10; a 10% boiling point temperature of greater than or equal to 600° F. (315° C.), greater than or equal to 650° F. (343° C.), or even greater than or equal to 900° F. (482° C.); a Conradson Carbon Residue of greater than or equal to 5 weight percent or greater than or equal to 10 weight percent; or combinations of these properties.

Referring to FIG. 2, the processes for producing heavy oils may further include passing the hydrocarbon feed 102 to the distillation system 110 that separates the hydrocarbon feed 102 into one or more distillation fractions and a residue and passing the residue to the thermal cracking unit 140 or the cracker effluent separation system 170 as the heavy oil stream 104. The hydrocarbon feed 102 may include crude oil, distilled crude oil, residue oil, topped crude oil, product streams from oil refineries, product streams from steam cracking processes, liquefied coals, liquids recovered from oil or tar sands, bitumen, shale oil, asphaltene, biomass hydrocarbons, or combinations of these. The distillation system 110 may have any of the features or operating conditions previously described for the distillation system 110. In embodiments, the distillation system 110 includes an atmospheric distillation unit, a vacuum distillation unit, or both.

The disulfide oil stream 128 may have any of the compositions, properties, or characteristics previously described for the disulfide oil stream 128. The disulfide oil of the disulfide oil stream 128 may comprise less than 20 wt. % water based on the total weight of the disulfide oil or the mass flow rate of the disulfide oil stream 128. The disulfide oil of the disulfide oil stream 128 may include greater than or equal to 5 wt. % or greater than or equal to 10 wt. % disulfide compounds based on the total weight of the disulfide oil or based on the mass flow rate of the disulfide oil stream 128. The disulfide oil of the disulfide oil stream 128 may have greater than or equal to 3 wt. % or greater than or equal to 5 wt. % total sulfur based on the total weight of the disulfide oil or the mass flow rate of the disulfide oil stream 128. The sulfur content of the disulfide oil of the disulfide oil stream 128 may be greater than the sulfur content of the heavy oil of the heavy oil stream 104. The sulfur content of the disulfide oil of the disulfide oil stream 128 may be greater than a sulfur content of the cracker bottom stream 176 from the cracker effluent separation system 170. Passing the disulfide oil stream 128 to the thermal cracking system 100 may increase the total sulfur content in the thermal cracking unit 140 by at least 3%, by at least 5%, or by at least by 7% compared to operation of the thermal cracking system 100 without the disulfide oil of the disulfide oil stream 128. The disulfide oil of the disulfide oil stream 132 may have an alkali metal content less than or equal to 100 parts per million by weight as determined through ICP-MS.

The disulfide oil stream 128 may include a disulfide oil effluent from a sweetening process for removing sulfur compounds from sulfur containing hydrocarbon streams. Referring again to FIG. 2, the processes for upgrading heavy oil may include treating a sulfur-containing hydrocarbon stream 122 in a sweetening process 120 that removes sulfur and sulfur compounds from the sulfur-containing hydrocarbon stream 122 to produce at least a reduced sulfur hydrocarbon stream 127 and the disulfide oil stream 128. The sweetening process 120 may have any of the features, units, or operating conditions discussed in the present disclosure for the sweetening process 120 or MEROX process 120' (FIG. 3). Referring again to FIG. 2, the processes may further include passing the disulfide oil stream 128 to the thermal cracking unit 140 as the disulfide oil. In embodiments, the sulfur-containing hydrocarbon stream 122 may be a mercaptan-containing stream, and the sweetening process may be a MEROX process that removes the mercaptan compounds from the mercaptan-containing stream. The processes may further include contacting the sulfur-containing hydrocarbon stream 122 with the oxygen-containing stream 124 and the alkaline stream 126 in the presence of the mercaptan oxidation catalyst, where the contacting may cause at least a portion of the sulfur compounds, such as mercaptan compounds, in the sulfur-containing hydrocarbon stream 122 to react to produce a sweetening effluent comprising at least the disulfide oil. The processes may further include treating the sweetening effluent to produce at least the disulfide oil stream 128 and the reduced sulfur hydrocarbon stream 127. The processes may further include passing at least a portion of the disulfide oil stream 128 to the thermal cracking unit 140.

Referring again to FIG. 2, the processes for upgrading heavy oil may include passing the cracker effluent 162 to the cracker effluent separation system 170 that separates the cracker effluent 162 into one or more product effluents 172, 174 and a cracker bottom stream 176. The cracker effluent separation system 170 may have any of the features or operating conditions previously discussed for the cracker effluent separation system 170. The processes may further include passing the heavy oil stream 104 to the cracker effluent separation system 170 that separates the heavy oil stream 104 and the cracker effluent 162 into the one or more product streams 172, 174 and the cracker bottom stream 176. Referring to FIG. 5, in embodiments, the processes may further include separating the cracker effluent 162 and heavy oil from the heavy oil stream 104 into a cracked gas effluent 174, a cracker naphtha effluent 178, a cracker gas oil effluent (light gas oil effluent 194, heavy gas oil effluent 196, or both, and the cracker bottom stream 176.

Referring again to FIGS. 1 and 2, the processes may further include combining the disulfide oil stream 128 with the cracker bottom stream 176 to produce the cracker feed 132 and passing the cracker feed 132 to the thermal cracking unit 140. The cracker feed 132 may include from 0.5 wt. % to 30 wt. %, such as from 1 wt. % to 20 wt. %, disulfide oil based on the total weight of the cracker feed 132. Combining the disulfide oil stream 128 with the cracker bottom stream 176 may include mixing the disulfide oil stream 128 and the cracker bottom stream 176 to produce the cracker feed 132. The mixing may include passing the disulfide oil stream 128 and the cracker bottom stream 176 through at least one static mixer upstream of the thermal cracking unit 140, where the at least one static mixer mixes the disulfide oil stream 128 and the cracker bottom stream 176 to produce the cracker feed 132.

The processes may further include passing the cracker feed 132 to the thermal cracking unit 140. The thermal cracking unit 140 may include the furnace 150 and one or a plurality of thermal cracking vessels 160 downstream of the furnace 150. The furnace 150 and the thermal cracking vessels 160, may have any of the features or operating conditions previously described in the present disclosure for these units. The processes may include heating the cracker feed 132 to a cracking temperature to produce a heated cracker feed 152 and passing the heated cracker feed 152 to the thermal cracking vessel(s) 160. The processes may include maintaining the thermal cracking vessels 160 at the cracking temperatures of from 450° C. to 600° C. to thermally crack one or more hydrocarbons from the heavy oil stream 104, one or more disulfide compounds from the disulfide oil stream 128, or both to produce the cracker effluent 162 and the solid coke 164, where the cracker effluent 162 includes the gaseous and liquid reaction products from the thermal cracking reactions. The thermal cracking system 100 may thermally crack at least a portion of the disulfide compounds from the disulfide oil stream 128 to produce additionally gaseous and liquid reaction products, which may increase the yield of the gaseous reaction products, the liquid reaction products, or both compared to operation of the thermal cracking system 100 without the disulfide oil stream 128.

The processes may further include removing solid coke 164 from the thermal cracking unit 140, such as from the thermal cracking vessel(s) 160. Referring to FIG. 4, the thermal cracking unit 140 may include a plurality of thermal cracking vessels (first coker drum 180, second coker drum 180', third coker drum 180"), and the processes may include passing the heated cracker feed 152 to the plurality of thermal cracking vessels 160 operated in parallel. The processes may include removing coke from each of the thermal cracking vessels 160 in sequence to maintain continuous operation of the thermal cracking unit 140.

EXAMPLES

The various aspects of systems and processes of the present disclosure will be further clarified by the following examples. The examples are illustrative in nature and should not be understood to limit the subject matter of the present disclosure.

In the Examples, the effects of introducing disulfide oil to a thermal cracking process are investigated. The thermal cracking system used in the Examples is the thermal cracking system 100 shown in FIG. 5. The thermal cracking system 100 includes a thermal cracking unit comprising a furnace 150 and a cracking vessel 160. The cracking vessel 160 is a coke drum. The thermal cracking system 100 further includes the cracker effluent separation system 170, which is a fractionation column. The heavy oil stream 104 is passed to the cracker effluent separation system 170 along with the cracker effluent 162. The cracker effluent separation system 170 separates the cracker effluent 162 and heavy oil stream 104 into a gaseous reaction product stream 172, a cracker naphtha stream 178, a cracker light gas oil 194, a cracker heavy gas oil 196, and a cracker bottom stream 176. The cracker bottom stream 176 is combined with a disulfide oil stream 128 to produce a cracker feed 132. The cracker feed 132 is passed to the furnace 150, which heats the cracker feed 132 to a temperature of 480° C. to produce a heated cracker feed 152. The heated cracker feed 152 is passed to the cracking vessel 160, where it is thermally cracked to produce a cracker effluent 162 and solid coke 164. The cracker effluent 162 is passed to the cracker effluent separation system 170 and the solid coke 164 is removed from the cracking vessel 160. A portion of the cracker bottom stream 176 is passed out of the thermal cracking system 100 as a cracker bottom bleed stream 177. The composition of the heavy oil stream 104 is provided below in Table 3.

TABLE 3

Composition of the Heavy Oil Stream in the Examples

| Property | Units | Value |
|---|---|---|
| Specific Gravity | API gravity | 5.4 |
| Total Sulfur | weight percent | 4.16 |
| Conradson Carbon Residue | weight percent | 20.0 |
| Viscosity at 100° C. | cSt | 8,500 |
| Iron Content | parts per million by weight | 5 |
| Vanadium Content | parts per million by weight | 91 |
| Nickel Content | parts per million by weight | 19 |
| Distillation Profile (ASTM D7169) | | |
| 5% | ° C. | 496 |
| 10% | ° C. | 516 |
| 20% | ° C. | 553 |
| 30% | ° C. | 580 |
| 50% | ° C. | 626 |
| 70% | ° C. | 678 |
| 80% | ° C. | 713 |
| 90% | ° C. | 792 |
| 95% | ° C. | 884 |

Example 1: Passing Disulfide Oil to the Thermal Cracking System

In Example 1, the effects of passing the disulfide oil stream 128 to the thermal cracking system 100 of FIG. 5 is evaluated. The thermal cracking system of FIG. 5 was modeled using Aspen-HYSYS process modeling software. The disulfide oil stream 128 is produced from a sweetening process for removing sulfur compounds from a naphtha stream. The disulfide oil stream 128 has the composition provided below in Table 4. The total sulfur content in the disulfide oil stream is 6.8 wt. % based on the total weight of the disulfide oil stream. Non sulfur compounds in the DSO are characterized to be hydrocarbons contained in naphtha fractions of crude oil, such as heptane and octane. Also, aromatic compounds such as xylene and ethylbenzene are included in the DSO as non-sulfur compounds.

TABLE 4

Composition of Disulfide Oil Stream in Example 1

| Constituent of Disulfide Oil | Weight Percent |
|---|---|
| Dimethyl Disulfide | 1.9 |
| Methyl Ethyl Disulfide | 2.8 |
| Methyl Propyl Disulfide | 2.2 |
| Diethyl Disulfide | 1.7 |
| Ethyl Propyl Disulfide | 1.2 |
| Dipropyl Disulfide | 1.8 |
| Ethyl Butyl Disulfide | 1.1 |
| Non-Sulfur Containing Compounds | 84.5 |
| Total | 100 |

In Example 1, 4 parts by weight of the disulfide oil stream 128 is combined with 100 parts by weight of the cracker bottom stream 176 to produce the cracker feed 132, which is passed to the furnace 150 and cracking vessel 160. The total sulfur content of the cracker bottom stream 176 is 2.4 wt. % based on the total weight of the cracker bottom stream 176. After combining the cracker bottom stream 176 and the disulfide oil stream 128 to produce the cracker feed 132, the cracker feed 132 has a total sulfur content of 2.57 wt. % sulfur based on the total weight of the cracker feed 132. Thus, adding the disulfide oil stream 128 increases the total sulfur content of the cracker feed 132 by 7% compared to a cracker feed comprising only the cracker bottom stream 176.

The cracker effluent is separated in a cracker effluent separation system 170 modeled using a conventional atmospheric distillation unit model to produce a gaseous product stream 172, the cracker naphtha stream 178, the cracker light gas oil 194, the cracker heavy gas oil 196, and the cracker bottom stream 176. The properties of the gaseous product stream 172, the cracker naphtha stream 178, the cracker light gas oil 194, the cracker heavy gas oil 196, the cracker bottom bleed stream 177, and the solid coke 164 for Example 1 are provided in Table 5.

Comparative Example 2: Conventional Thermal Cracking without Disulfide Oil Stream In Comparative Example 2, thermal cracking of the heavy oil stream 104 is conducted using the system 100 of FIG. 5 without the addition of the disulfide oil stream 128 to the cracker bottom stream 176. Except for removal of the disulfide oil stream 128, operation of the system 100 and the modeling assumptions for Comparative Example 2 are the same as provided above in Example 1. The properties of the gaseous product stream 172, the cracker naphtha stream 178, the cracker light gas oil 194, the cracker heavy gas oil 196, the cracker bottom bleed stream 177, and the solid coke 164 for Comparative Example 2 are provided in Table 5.

In the following Table 5, the Percent of Total Out is the weight percent of the stream based on the total weight of materials output from the thermal cracking system 100. In Table 5, the Research Octane Number (RON) refers to a property of fuels that is related to the amount of compression the fuel can withstand before detonating. RON may be determined according to ASTM D2699. In Table 5, the Cetane Index is determined according to ASTM D976 and is an index value indicative of the quality of gas oil based upon density and volatility.

TABLE 5

Stream Compositions and Properties for Example 1 and Comparative Example 2

| Stream | Property | Units | Example 1 | Comparative Example 2 |
|---|---|---|---|---|
| Gaseous reaction product stream 172 | Percent of Total Out | wt. % | 12.7 | 10.9 |
| | Sulfur Content | wt. % | 1.5 | 1.1 |
| Cracker naphtha stream 178 | Percent of Total Out | wt. % | 12.9 | 12.4 |
| | API Gravity | — | 61.5 | 63.6 |
| | Sulfur Content | wt. % | 0.57 | 0.49 |
| | RON | — | 72.5 | 72.5 |
| Cracker light gas oil 194 | Percent of Total Out | wt. % | 11.3 | 10.7 |
| | API Gravity | — | 38.5 | 38.9 |
| | Sulfur Content | wt. % | 0.93 | 0.92 |
| | Cetane Index | — | 40.3 | 40.3 |
| Cracker heavy gas oil 196 | Percent of Total Out | wt. % | 10.4 | 10.1 |
| | API Gravity | — | 26.9 | 27.4 |
| | Sulfur Content | wt. % | 1.61 | 1.60 |
| | Cetane Index | — | 42.1 | 42.1 |
| Cracker bottom bleed stream 177 | Percent of Total Out | wt. % | 22.6 | 20.9 |
| | API Gravity | — | 17.7 | 18.5 |
| | Sulfur Content | wt. % | 2.4 | 2.10 |
| | Conradson Carbon | wt. % | 0.9 | 1.2 |
| Solid coke 164 | Percent of Total Out | wt.% | 30.1 | 35.0 |
| | Sulfur Content | wt. % | 5.0 | 4.4 |
| | Vanadium | wt. % | 305 | 262 |
| | Nickel | wt. % | 65 | 52 |

As shown in Table 5, by injecting the disulfide oil stream 128 as in Example 1, the coke yield decreases from 35 wt. % to 30.1 wt. % based on the total weight of the streams output from the system, while the liquid product yields (cracker naphtha stream 178, cracker light gas oil 194, cracker heavy gas oil 196, and cracker bottom bleed stream 177) increase from a total of 54.1 wt. % to a total of 57.2 wt. % based on the total weight of the streams output from the system. The yields of the greater value gaseous and liquid products (gaseous reaction product stream 172, cracker naphtha stream 178, cracker light gas oil 194, and cracker heavy gas oil 196) increase from 44.1 wt. % to a total of 47.3 wt. % based on the total weight of the streams output from the system. Thus, Example 1 demonstrates that passing disulfide oil to the thermal cracking unit, such as a delayed coker, can increase the yield of greater value gaseous and liquid reaction products and reduce the production of solid coke compared to operation of the thermal cracking unit without the disulfide oil.

In a first aspect of the present disclosure, a process for upgrading a heavy oil may include passing heavy oil and disulfide oil to a thermal cracking system comprising a thermal cracking unit and a cracker effluent separation system downstream of the thermal cracking unit and thermally cracking at least a portion of the heavy oil in the presence of the disulfide oil in the thermal cracking unit to produce solid coke and a cracking effluent comprising one or more reaction products. The one or more reaction products may comprise one or more liquid reaction products, one or more gaseous reaction products, or both. The presence of the disulfide oil may promote conversion of hydrocarbons from the heavy oil to the liquid reaction products, the gaseous reaction products, or both over the solid coke.

A second aspect of the present disclosure may include the first aspect, where the heavy oil may be a residue from distillation of a hydrocarbon feed.

A third aspect of the present disclosure may include the second aspect, where the residue is an atmospheric residue, a vacuum residue, or a combination of these.

A fourth aspect of the present disclosure may include either one of the second or third aspects, where the hydrocarbon feed may comprise crude oil, distilled crude oil, residue oil, topped crude oil, product streams from oil refineries, product streams from steam cracking processes, liquefied coals, liquids recovered from oil or tar sands, bitumen, shale oil, asphaltene, biomass hydrocarbons, or combinations of these.

A fifth aspect of the present disclosure may include any one of the first through fourth aspects, where the heavy oil may have one or more of the following properties: an API gravity less than or equal to 16 or less than or equal to 10; a 10% boiling point temperature of greater than or equal to 600 degrees Fahrenheit (315° C.), greater than or equal to 650 degrees Fahrenheit (343° C.) or even greater than or equal to 900 degrees Fahrenheit (482° C.); a Conradson Carbon Residue of greater than or equal to 5 weight percent or greater than or equal to 10 weight percent; or combinations of these properties.

A sixth aspect of the present disclosure may include any one of the first through fifth aspects, where the disulfide oil may comprise less than 20 weight percent water based on the total weight of the disulfide oil.

A seventh aspect of the present disclosure may include any one of the first through sixth aspects, where the disulfide oil may comprise greater than or equal to 5 weight percent or greater than or equal to 10 weight percent disulfide compounds based on the total weight of the disulfide oil.

An eighth aspect of the present disclosure may include any one of the first through seventh aspects, where the disulfide oil may comprise greater than or equal to 3 weight percent or greater than or equal to 5 weight percent total sulfur based on the total weight of the disulfide oil.

A ninth aspect of the present disclosure may include any one of the first through eighth aspects, where a sulfur content of the disulfide oil may be greater than a sulfur content of the heavy oil.

A tenth aspect of the present disclosure may include any one of the first through ninth aspects, where the disulfide oil may have an alkali metal content less than or equal to 100 parts per million by weight as determined through inductively coupled plasma mass spectrometry.

An eleventh aspect of the present disclosure may include any one of the first through tenth aspects, where passing the disulfide oil to the thermal cracking system may increase the total sulfur content in the thermal cracking unit by at least 3%, by at least 5%, or by at least by 7% compared to operation of the thermal cracking system without the disulfide oil.

A twelfth aspect of the present disclosure may include any one of the first through eleventh aspects, where the thermal cracking unit may comprise a delayed coker, a visbreaker, or combinations of these.

A thirteenth aspect of the present disclosure may include any one of the first through twelfth aspects, further comprising passing the cracker effluent to the cracker effluent separation system that separates the cracker effluent into one or more product effluents and a cracker bottom stream.

A fourteenth aspect of the present disclosure may include the thirteenth aspect, where a sulfur content of the disulfide oil may be greater than a sulfur content of the cracker bottom stream.

A fifteenth aspect of the present disclosure may include either one of the thirteenth or fourteenth aspects, comprising passing the heavy oil to the cracker effluent separation system that separates the heavy oil and the cracker effluent into the one or more product streams and the cracker bottom stream, combining the disulfide oil with the cracker bottom stream to produce a cracker feed, and passing the cracker feed to the thermal cracking unit.

A sixteenth aspect of the present disclosure may include the fifteenth aspect, where the cracker feed may comprise from 0.5 weight percent to 30 weight percent disulfide oil based on the total weight of the cracker feed.

A seventeenth aspect of the present disclosure may include either one of the fifteenth or sixteenth aspects, where a mass flow ratio of the disulfide oil to the cracker bottom stream is from 0.005 to 0.430.

An eighteenth aspect of the present disclosure may include any one of the fifteenth through seventeenth aspects, where combining the disulfide oil with the cracker bottom stream may further comprise mixing the disulfide oil and the cracker bottom stream to produce the cracker feed.

A nineteenth aspect of the present disclosure may include the eighteenth aspect, where mixing may comprise passing the disulfide oil and the cracker bottom stream through at least one static mixer upstream of the thermal cracking unit, where the at least one static mixer mixes the disulfide oil with the cracker bottom stream to produce the cracker feed.

A twentieth aspect of the present disclosure may include any one of the first through nineteenth aspects, where the thermal cracking unit may comprise a furnace and a thermal cracking vessel downstream of the furnace.

A twenty-first aspect of the present disclosure may include any one of the first through twentieth aspects, further comprising removing solid coke from the thermal cracking unit.

A twenty-second aspect of the present disclosure may include any one of the first through twenty-first aspects, comprising separating the cracker effluent into a cracked gas effluent, a cracker naphtha effluent, a cracker gas oil effluent, and the cracker bottom stream.

A twenty-third aspect of the present disclosure may include any one of the first through twenty-second aspects, where the disulfide oil may comprise a disulfide oil effluent from a sweetening process.

A twenty-fourth aspect of the present disclosure may include the twenty-third aspect, where the sweetening process may be a mercaptan oxidation process (MEROX process).

A twenty-fifth aspect of the present disclosure may include any one of the first through twenty-fourth aspects, further comprising treating a sulfur containing hydrocarbon stream in a sweetening process that removes sulfur and sulfur compounds from the sulfur containing hydrocarbon stream to produce at least a reduced sulfur hydrocarbon stream and a disulfide oil stream and passing the disulfide oil stream to the thermal cracking system as the disulfide oil.

A twenty-sixth aspect of the present disclosure may include any one of the first through twenty-fifth aspects, where the thermal cracking system may crack at least a portion of disulfide compounds in the disulfide oil to increase the yield of the gaseous reaction products, the liquid reaction products, or both.

A twenty-seventh aspect of the present disclosure may include any one of the first through twenty-sixth aspects, where passing the disulfide oil to the thermal cracking system may increase the yield of high-grade coke such as anode grade coke, or may reduce impurities in the coke produced by the thermal cracking system compared to operating the thermal cracking system without the disulfide oil.

It is noted that any two quantitative values assigned to a property may constitute a range of that property, and all combinations of ranges formed from all stated quantitative values of a given property are contemplated in this disclosure.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific aspects, it is noted that the various details of such aspects should not be taken to imply that these details are essential components of the aspects. Rather, the claims appended hereto should be taken as the sole representation of the breadth of the present disclosure and the corresponding scope of the various aspects described in this disclosure. Further, it will be apparent that modifications and variations are possible without departing from the scope of the appended claims.

What is claimed is:

1. A process for upgrading a heavy oil, the process comprising:

passing heavy oil and disulfide oil to a thermal cracking system comprising a thermal cracking unit and a cracker effluent separation system downstream of the thermal cracking unit, where passing the disulfide oil to the thermal cracking system increases the total sulfur content in the thermal cracking unit by at least 3% compared to operation of the thermal cracking system without the disulfide oil;

thermally cracking at least a portion of the heavy oil in the presence of the disulfide oil in the thermal cracking unit to produce solid coke and a cracking effluent comprising one or more reaction products, where:

the one or more reaction products comprise one or more liquid reaction products, one or more gaseous reaction products, or both; and the presence of the disulfide oil promotes conversion of hydrocarbons from the heavy oil to the liquid reaction products, the gaseous reaction products, or both over the solid coke.

2. The process of claim 1, where the heavy oil is an atmospheric residue, a vacuum residue, or a combination of these produced from distillation of a hydrocarbon feed.

3. The process of claim 2, where the hydrocarbon feed comprises crude oil, distilled crude oil, residue oil, topped crude oil, product streams from oil refineries, product streams from steam cracking processes, liquefied coals, liquids recovered from oil or tar sands, bitumen, shale oil, asphaltene, biomass hydrocarbons, or combinations of these.

4. The process of claim 1, where the heavy oil has one or more of the following properties:

an API gravity less than or equal to 16;

a 10% boiling point temperature of greater than or equal to 600 degrees Fahrenheit (315° C.); or a Conradson Carbon Residue of greater than or equal to 5 weight percent.

5. The process of claim 1, where the disulfide oil comprises less than 20 weight percent water based on the total weight of the disulfide oil.

6. The process of claim 1, where the disulfide oil comprises greater than or equal to 5 weight percent disulfide compounds based on the total weight of the disulfide oil.

7. The process of claim 1, where the disulfide oil comprises greater than or equal to 3 weight percent total sulfur based on the total weight of the disulfide oil.

8. The process of claim 1, where a sulfur content of the disulfide oil is greater than a sulfur content of the heavy oil.

9. The process of claim 1, where the disulfide oil has an alkali metal content less than or equal to 100 parts per million by weight as determined through inductively coupled plasma mass spectrometry.

10. The process of claim 1, where the thermal cracking unit comprises a delayed coker, a visbreaker, or combinations of these.

11. The process of claim 1, further comprising passing the cracker effluent to the cracker effluent separation system that separates the cracker effluent into one or more product effluents and a cracker bottom stream.

12. The process of claim 11, where a sulfur content of the disulfide oil is greater than a sulfur content of the cracker bottom stream.

13. The process of claim 11, comprising:

passing the heavy oil to the cracker effluent separation system that separates the heavy oil and the cracker effluent into the one or more product streams and the cracker bottom stream;

combining the disulfide oil with the cracker bottom stream to produce a cracker feed; and passing the cracker feed to the thermal cracking unit.

14. The process of claim 13, where the cracker feed comprises from 0.5 weight percent to 30 weight percent disulfide oil based on the total weight of the cracker feed.

15. The process of claim 13, where combining the disulfide oil with the cracker bottom stream further comprises mixing the disulfide oil and the cracker bottom stream to produce the cracker feed.

16. The process of claim 15, where mixing comprises passing the disulfide oil and the cracker bottom stream through at least one static mixer upstream of the thermal cracking unit, where the at least one static mixer mixes the disulfide oil with the cracker bottom stream to produce the cracker feed.

17. The process of claim 1, where the disulfide oil comprises a disulfide oil effluent from a sweetening process.

18. The process of claim 1, further comprising:

treating a sulfur containing hydrocarbon stream in a sweetening process that removes sulfur and sulfur compounds from the sulfur containing hydrocarbon stream to produce at least a reduced sulfur hydrocarbon stream and a disulfide oil stream; and passing the disulfide oil stream to the thermal cracking system as the disulfide oil.

19. The process of claim 1, where the thermal cracking system cracks at least a portion of disulfide compounds in the disulfide oil to increase the yield of the gaseous reaction products, the liquid reaction products, or both.

20. The process of claim 1, where disulfide oil comprises disulfide compounds having the general formula (I):

$$R^1—S—S—R^2 \quad (I)$$

where $R^1$ and $R^2$ are both hydrocarbyl groups.

* * * * *